US011434915B2

(12) United States Patent
Oleson et al.

(10) Patent No.: US 11,434,915 B2
(45) **Date of Patent: *Sep. 6, 2022**

(54) CEILING FAN WITH VARIABLE BLADE PITCH AND VARIABLE SPEED CONTROL

(71) Applicant: Delta T, LLC, Lexington, KY (US)

(72) Inventors: Richard A. Oleson, Lexington, KY (US); Richard W. Fizer, Lexington, KY (US); H. Keith Kidd, Christiansburg, VA (US)

(73) Assignee: DELTA T, LLC, Lexington, KY (US)

( * ) Notice: Subject to any disclaimer, the term of this patent is extended or adjusted under 35 U.S.C. 154(b) by 273 days.

This patent is subject to a terminal disclaimer.

(21) Appl. No.: 14/275,394

(22) Filed: May 12, 2014

(65) Prior Publication Data

US 2015/0023802 A1 Jan. 22, 2015

Related U.S. Application Data

(63) Continuation of application No. 12/773,094, filed on May 4, 2010, now Pat. No. 8,721,305.
(Continued)

(51) Int. Cl.
*F04D 25/08* (2006.01)
*F04D 27/00* (2006.01)
(Continued)

(52) U.S. Cl.
CPC ..... *F04D 25/088* (2013.01); *F04D 27/002* (2013.01); *F04D 27/004* (2013.01);
(Continued)

(58) Field of Classification Search
CPC ..... F04D 25/088; F04D 25/10; F04D 29/34; F04D 29/36; F04D 29/364; F04D 29/366;
(Continued)

(56) References Cited

U.S. PATENT DOCUMENTS 2,620,039 A * 7/1951 Allen ..... F04D 29/36 416/207
RE23,448 E * 12/1951 Pullin ..... B64C 27/18 416/20 R
(Continued)

FOREIGN PATENT DOCUMENTS

EP 1845268 A1 10/2007

*Primary Examiner* — Dominick L Plakkoottam
*Assistant Examiner* — Charles W Nichols
(74) *Attorney, Agent, or Firm* — Dickinson Wright PLLC; Andrew D. Dorisio

(57) ABSTRACT

A fan comprises a hub, fan blades, and inserts. The hub comprises outwardly extending mounting tabs that lie along a common horizontal plane. The fan blades are hollow, such that each mounting tab is inserted in the hollow interior of a corresponding fan blade. Each insert is positioned in the hollow interior of each fan blade, between each mounting tab of the hub and the interior surface of the corresponding fan blade. Each insert is configured to position and maintain the chord line of each corresponding fan blade at an oblique angle relative to the horizontal plane of the hub. A kit may include several insert sets to choose from to provide adjustable angle of attack. A fan control system includes a dimmer switch and a control module, which allows the dimmer switch to be used to infinitely adjust the speed of a fan motor within a range.

17 Claims, 17 Drawing Sheets

Related U.S. Application Data

(60) Provisional application No. 61/175,210, filed on May 4, 2009.

(51) Int. Cl.
*F04D 29/34* (2006.01)
*F04D 29/36* (2006.01)
*H05B 39/08* (2006.01)

(52) U.S. Cl.
CPC ..... *F04D 27/007* (2013.01); *F04D 29/34* (2013.01); *F04D 29/36* (2013.01); *H05B 39/08* (2013.01)

(58) Field of Classification Search
CPC ..... F04D 25/06; F04D 25/06; F04D 25/08; F04D 27/004; F04D 27/0261; F04D 29/28; F04D 29/281; F04D 29/30; F04D 29/32; F04D 29/325; F04D 29/329; F04D 29/38; F04D 29/384; F04D 29/388; F04D 29/403; F04D 29/4206; F04D 29/4226; F04D 27/002; F04D 27/007; H05B 39/08; Y02B 30/70
See application file for complete search history.

(56) References Cited

U.S. PATENT DOCUMENTS 4,191,506 A * 3/1980 Packham ..... 416/91
4,605,355 A * 8/1986 Davis ..... B64C 11/04 415/912
4,719,446 A * 1/1988 Hart ..... 340/12.32
5,520,515 A * 5/1996 Bailey ..... F04D 29/36 416/208
6,005,308 A * 12/1999 Bryde ..... H05B 39/00 200/335
6,357,667 B1 * 3/2002 Young ..... G05D 23/1905 236/49.3
7,196,485 B1 * 3/2007 Lee et al. ..... 318/400.38
7,252,478 B2 * 8/2007 Aynsley ..... 416/204 R
7,771,168 B2 * 8/2010 Olthof ..... F04D 29/36 416/153
8,721,305 B2 * 5/2014 Oleson et al. ..... 417/423.1
2004/0042903 A1 3/2004 Huang
2005/0104543 A1 * 5/2005 Kazanov ..... H05B 47/105 315/294
2006/0018751 A1 1/2006 Aynsley
2006/0273751 A1 * 12/2006 DeJonge ..... H02P 25/04 318/772
2007/0110192 A1 * 5/2007 Steiner ..... H04B 3/54 375/343
2008/0031726 A1 * 2/2008 Bernardus Olthof ... F04D 29/36 415/115
2008/0265685 A1 * 10/2008 Blair ..... H05B 37/0272 307/141

* cited by examiner

CEILING FAN WITH VARIABLE BLADE PITCH AND VARIABLE SPEED CONTROL

PRIORITY

This application claims priority to U.S. Provisional Patent Application Ser. No. 61/175,210, filed May 4, 2009, entitled "Ceiling Fan with Variable Blade Pitch and Variable Speed Control," the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in Pub. No. 2008/0008596, entitled "Fan Blades," published Jan. 10, 2008; and Pub. No. 2009/0208333, entitled "Ceiling Fan System with Brushless Motor," published Aug. 20, 2009, the disclosures of which are also incorporated by reference herein. It should be understood that teachings herein may be incorporated into any of the fans described in any of the above-referenced patents, publications, or patent applications.

A fan blade or airfoil may include one or more upper air fences and/or one or more lower air fences at any suitable position(s) along the length of the fan blade or airfoil. Merely exemplary air fences are described in U.S. Provisional Patent App. No. 61/248,158, entitled "Air Fence for Fan Blade," filed Oct. 2, 2009, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Design Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pub. No. 2009/0081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pub. No. 2009/0072108, entitled "Ceiling Fan with Angled Mounting," published Mar. 19, 2009, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Examples of such mounting structures are shown in U.S. Design application Ser. No. 29/356,978, entitled "Fan with Ground Support," filed Mar. 5, 2010, the disclosure of which is incorporated by reference herein; and U.S. Design application Ser. No. 29/356,980, entitled "Fan with Ground Support and Winglets," filed Mar. 5, 2010, the disclosure of which is incorporated by reference herein. Alternatively, any other suitable mounting structures and/or mounting techniques may be used in conjunction with embodiments described herein.

In some settings, it may be desirable to provide additional reinforcement to the attachment of fan blades to a fan hub. Examples of such reinforcement are disclosed in U.S. Provisional Patent App. No. 61/326,855, entitled "Fan Blade Retention System," filed Apr. 22, 2010, the disclosure of which is incorporated by reference herein. In addition or in the alternative, other types of reinforcement may be used in conjunction with embodiments described herein. Alternatively, such reinforcement may simply be omitted.

A fan may also be provided with an integral light. Examples of such integral lights are disclosed in U.S. Provisional Patent App. No. 61/310,512, entitled "Fan with Integral Light," filed Mar. 4, 2010, the disclosure of which is incorporated by reference herein. In addition or in the alternative, other types of lights may be used in conjunction with embodiments described herein. Alternatively, a light or lights may simply be omitted.

It should also be understood that a fan may include sensors or other features that are used to control, at least in part, operation of a fan system. For instance, such fan systems are disclosed in U.S. Pub. No. 2009/0097975, entitled "Ceiling Fan with Concentric Stationary Tube and Power-Down Features," published Apr. 16, 2009, the disclosure of which is incorporated by reference herein; U.S. Pub. No. 2009/0162197, entitled "Automatic Control System and Method to Minimize Oscillation in Ceiling Fans," published Jun. 25, 2009, the disclosure of which is incorporated by reference herein; WIPO Pub. No. WO/2009/100052, entitled "Automatic Control System for Ceiling Fan Based on Temperature Differentials," published Aug. 13, 2009, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

While a variety of fans and fan systems have been made and used, it is believed that no one prior to the inventors has made or used a fan system as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
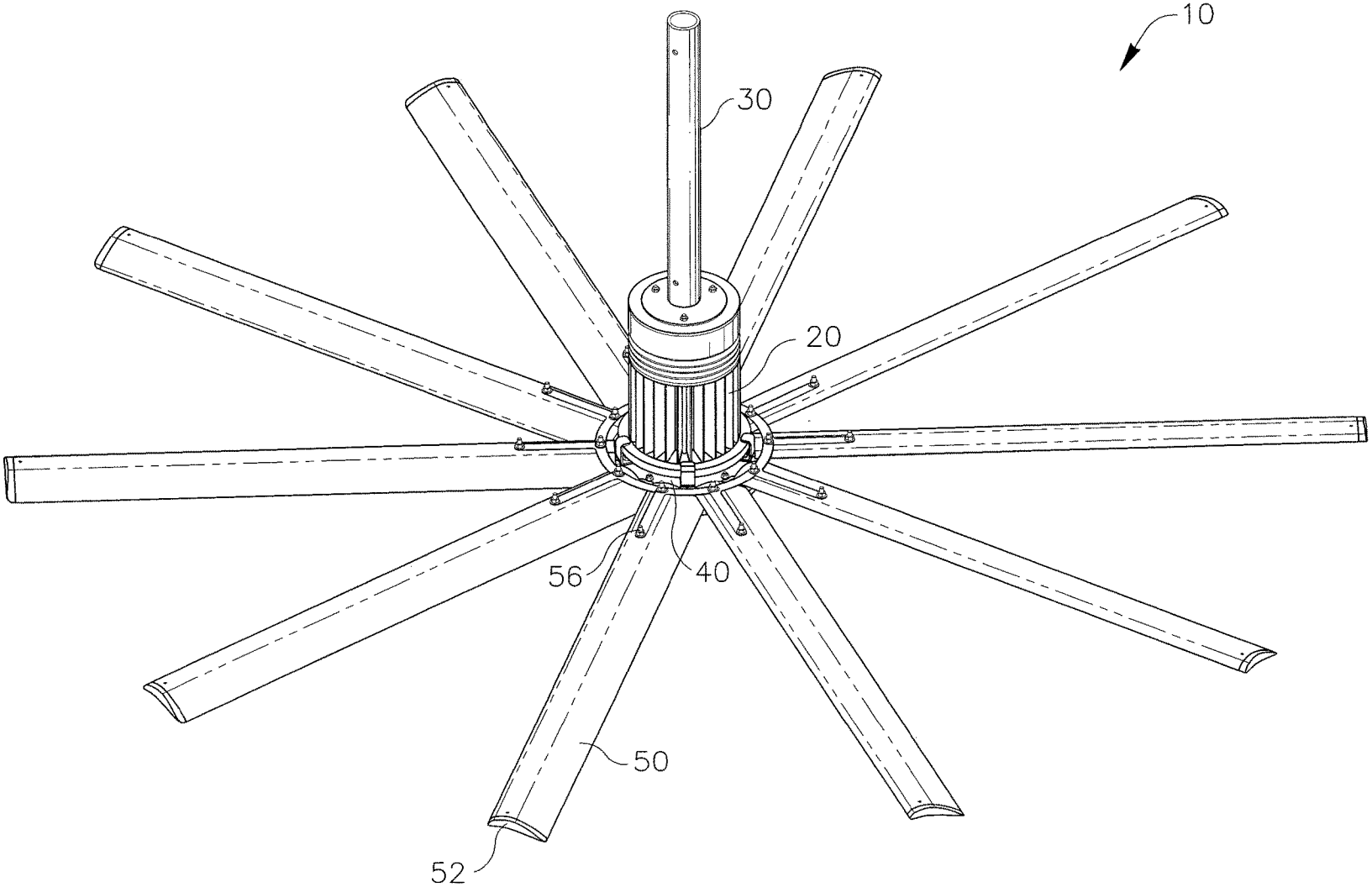
FIG. 1 depicts a top perspective view of an exemplary fan system.
Figure 2:
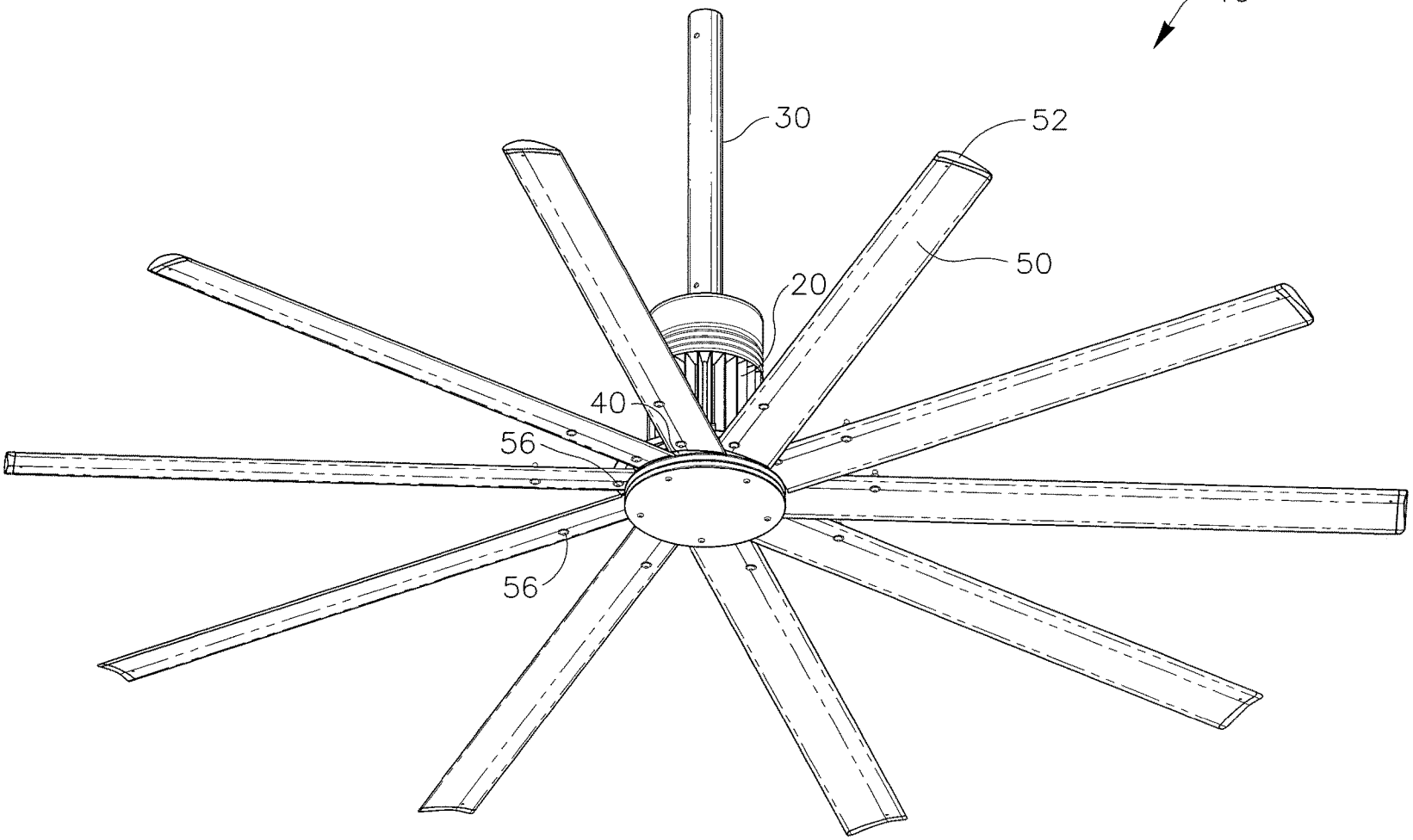
FIG. 2 depicts a bottom perspective view of the fan system of FIG. 1.
Figure 3:
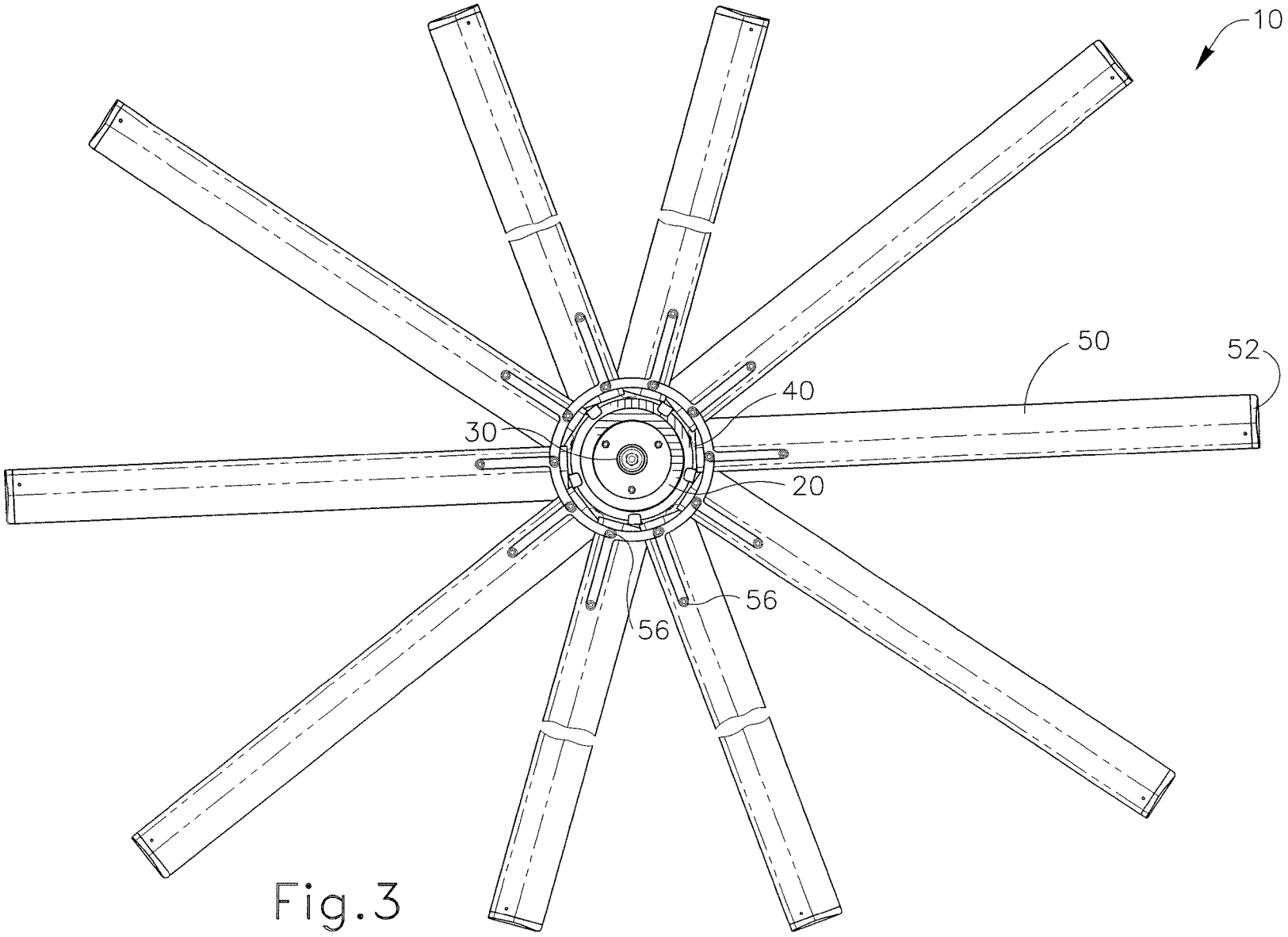
FIG. 3 depicts a top plan view of the fan system of FIG. 1.
Figure 4:
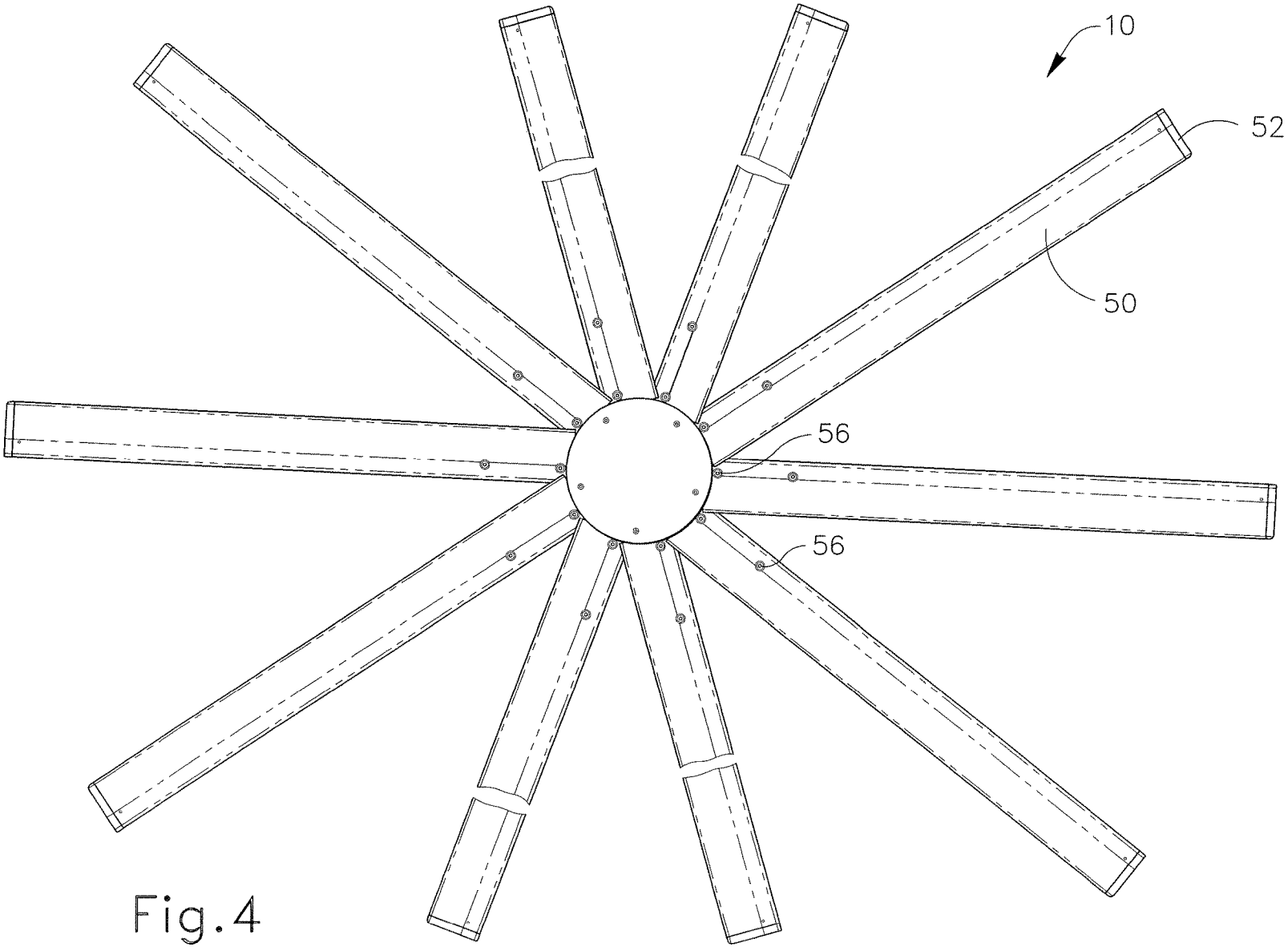
FIG. 4 depicts a bottom plan view of the fan system of FIG. 1.
Figure 5:
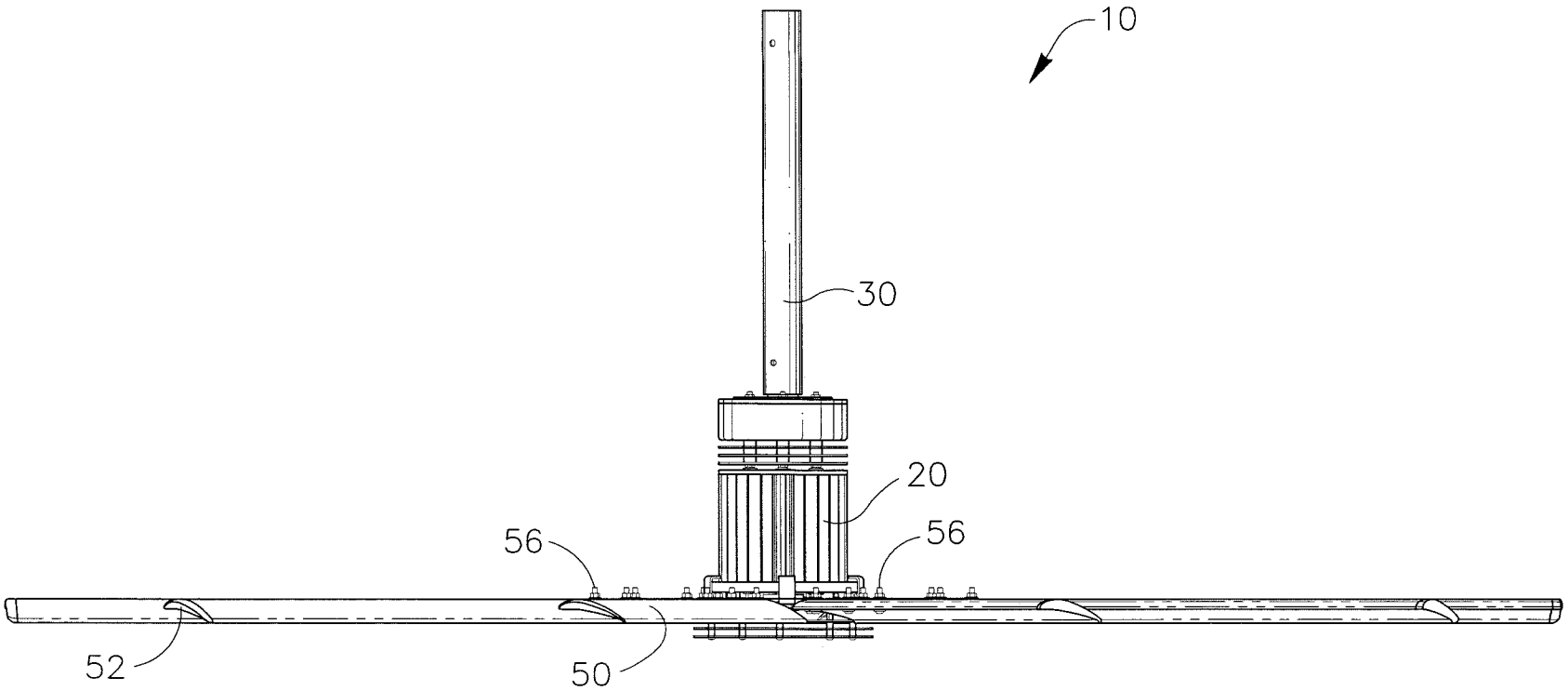
FIG. 5 depicts a side elevational view of the fan system of FIG. 1.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Fan System Overview

As shown in FIGS. 1-5, the fan system (10) of the present example comprises a motor (20), a mounting fixture (30), a hub (40), and blades (50). In the present example, fan (10) (i.e., with blades (50)) has a diameter of approximately 8 feet. In other variations, fan (10) has a diameter between approximately 6 feet, inclusive, and approximately 24 feet, inclusive. Alternatively, fan (10) may have any other suitable dimensions.

Fan blades (50) have an airfoil shape in the present example, and may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades (50) may be configured in accordance with the teachings of U.S. Pub. No. 2008/0008596, entitled "Fan Blades," published Jan. 10, 2008, the disclosure of which is also incorporated by reference herein. As yet another merely illustrative example, fan blades (50) may be configured in accordance with the teachings of U.S. Non-Provisional patent application Ser. No. 12/607,161, entitled "Multi-Part Modular Airfoil Section and Method of Attachment between Parts," filed Oct. 28, 2009, the disclosure of which is incorporated by reference herein. Alternatively, any other suitable configurations for fan blades (50) may be used in conjunction with embodiments described herein. In addition, while fan blades (50) of the present example are formed of aluminum through an extrusion process, such that each fan blade (50) has a substantially uniform cross section along its length, it should be understood that fan blades (50) may be formed using any suitable material(s) (including combinations of materials) using any suitable technique(s) (including combinations of techniques) and may have any suitable cross-sectional properties or other properties.

Fan blades (50) that are used with fan system (10) of the present example may include a variety of modifications. In the present example, the outer tip of each fan blade (50) is finished by the addition of a cap (52), which has a profile that complements the profile of fan blades (50). As another merely illustrative example, the outer tip of each fan blade (50) may be finished by the addition of an aerodynamic tip or winglet. By way of example only, winglets may be configured in accordance with the teachings of U.S. Pat. No. 7,252,478, entitled "Fan Blade Modifications," issued Aug. 7, 2007, the disclosure of which is incorporated by reference herein. As another merely illustrative example, winglets may be configured in accordance with the teachings of U.S. Pub. No. 2008/0014090, entitled "Cuffed Fan Blade Modifications," published Jan. 17, 2008, filed Sep. 25, 2007, the disclosure of which is incorporated by reference herein. As yet another merely illustrative example, winglets may be configured in accordance with the teachings of U.S. Design Pat. No. D587,799, entitled "Winglet for a Fan Blade," issued Mar. 3, 2009, the disclosure of which is incorporated by reference herein.

In still other variations, an angled extension may be added to the free end of each fan blade (50), such as the angled airfoil extensions described in U.S. Pub. No. 2008/0213097, entitled "Angled Airfoil Extension for Fan Blade," published Sep. 4, 2008, the disclosure of which is incorporated by reference herein. Other suitable structures that may be associated with an outer tip of each fan blade (52) will be apparent to those of ordinary skill in the art in view of the teachings herein. Alternatively, the outer tip of each fan blade (50) may be simply closed or capped (e.g., as in the present example, etc.), or may lack any similar structure at all.

Fan blades (50) are secured to fan hub (40), as will be described in greater detail below with reference to FIGS. 6-12. Hub (40) may be configured in accordance with the teachings of U.S. Pub. No. 2009/0208333, entitled "Ceiling Fan System with Brushless Motor," published Aug. 20, 2009, the disclosure of which is incorporated by reference herein. Alternatively, hub (40) may have any other suitable configuration. It should also be understood that the coupling of fan blades (50) with hub (40) may be further reinforced in a variety of ways. By way of example only, the coupling of fan blades (50) with hub (40) may be further reinforced in accordance with the teachings of U.S. Provisional Patent App. No. 61/326,855, entitled "Fan Blade Retention System," filed Apr. 22, 2010, the disclosure of which is incorporated by reference herein. In addition or in the alternative, the coupling of fan blades (50) with hub (40) may be further reinforced in accordance with the teachings of U.S. Pub. No. 2009/0208333, entitled "Ceiling Fan System with Brushless Motor," published Aug. 20, 2009, the disclosure of which is incorporated by reference herein. In addition or in the alternative, other types of reinforcement may be used in conjunction with embodiments described herein. Alternatively, such reinforcement may simply be omitted.

The interface of each fan blade (50) and fan hub (40) of the present example may also be provided in a variety of ways. For instance, an interface component (not shown) may be provided at the interface of each fan blade (50) and fan hub (40) in the present example. By way of example only, such an interface component may be configured in accordance with the teachings of U.S. Pub. No. 2009/0081045, entitled "Aerodynamic Interface Component for Fan Blade," published Mar. 26, 2009, the disclosure of which is incorporated by reference herein. Of course, an interface component may have any other suitable configuration. Alternatively, the interface of a fan blade (50) and a fan hub (40) may include any other component or components, or may lack any similar structure at all.

Mounting fixture (30) of the present example comprises an elongate metal tube-like structure that couples fan (10) to a ceiling. Alternatively, mounting fixture (30) may be configured in accordance with the teachings of U.S. Pub. No. 2009/0072108, entitled "Ceiling Fan with Angled Mounting," published Mar. 19, 2009, the disclosure of which is incorporated by reference herein. Alternatively, mounting fixture (30) may have any other suitable configuration. By way of example only, fan (10) need not be mounted to a ceiling or other overhead structure, and instead may be mounted to a wall or to the ground. For instance, fan (10) may be supported on the top of a post that extends upwardly from the ground. Examples of such mounting structures are shown in U.S. Design application Ser. No. 29/356,978, entitled "Fan with Ground Support," filed Mar. 5, 2010, the disclosure of which is incorporated by reference herein; and U.S. Design application Ser. No. 29/356,980, entitled "Fan with Ground Support and Winglets," filed Mar. 5, 2010, the disclosure of which is incorporated by reference herein. Alternatively, fan (10) may be mounted in any other suitable fashion at any other suitable location.

Motor (20) may comprise a permanent magnet brushless DC motor or any other suitable type of motor (e.g., brushed, inside-out, etc.). By way of example only, motor (20) may be constructed in accordance with the teachings of U.S. Pub. No. 2009/0208333, entitled "Ceiling Fan System with Brushless Motor," published Aug. 20, 2009, the disclosure of which is incorporated by reference herein. Furthermore, any other component(s) of fan (10) may be made and/or operated in accordance with any suitable teachings of U.S. Pub. No. 2009/0208333; and/or in accordance with any suitable teachings of any other document referenced herein. Alternatively, motor (20) may have any other suitable components, configurations, functionalities, and operability, as will be understood by those of ordinary skill in the art in view of the teachings herein.

Variable Blade Pitch

Figure 6:
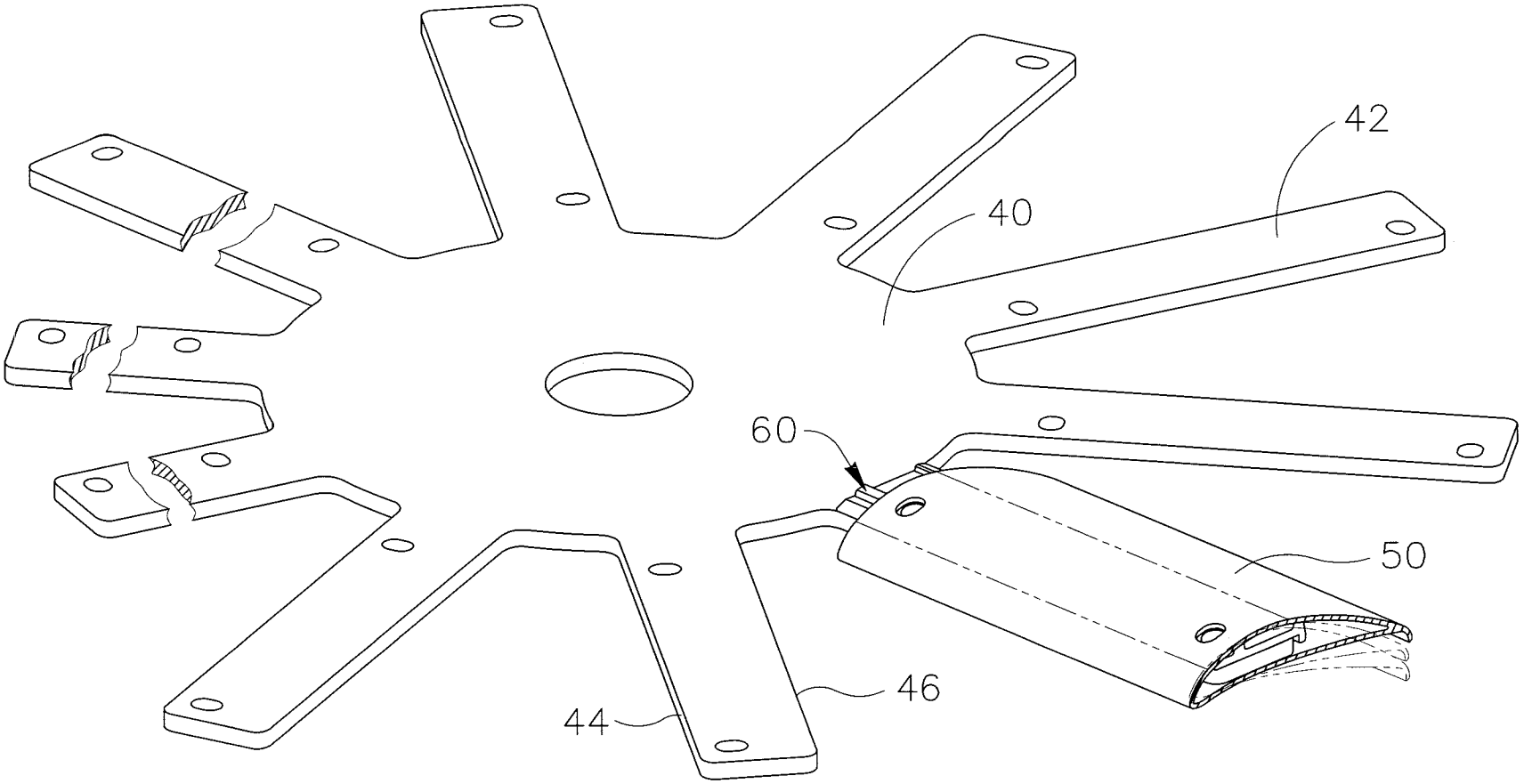
FIG. 6 depicts a top perspective view of a hub component of the fan system of FIG. 1, with a blade portion and pitch angle insert portion showing the blade portion at several pitch angles.

As shown in FIGS. 6-12, fan system (10) may be modified with relative ease to provide variable pitch of blades (50). In particular, and as shown in FIG. 6, hub (40) of the present example comprises a plurality of tabs (42) extending radially outwardly. Hub (40) and tabs (42) are substantially flat in this example. In other words, tabs (42) are substantially co-planar with the remainder of hub (40). For instance, hub (40) and tabs (42) may be formed simply by stamping a flat piece of metal, or using any other suitable material(s) and/or techniques. Each tab (42) has a leading edge (44) and a trailing edge (46). With blades (50) being hollow in this example, blades (50) are first engaged with hub (40) by inserting each tab (42) into the interior of a corresponding fan blade (50), then inserting fasteners (56) through tabs (42) and blades (50) to secure the attachments. Fasteners (56) of the present example comprise bolts, though it should be understood that any other suitable type of fasteners (56) or securing techniques may be used, including but not limited to rivets, screws, welds, adhesives, snap-fittings, interference fittings, etc., including combinations thereof. It should also be understood that hub (40) and blades (50) may be configured such that blades (50) are inserted into corresponding portions of hub (40) (e.g., in addition to or in lieu of tabs (42) being inserted into the interior of blades (50), etc.); and that hub (40) and blades (50) may have any other suitable components, features, configurations, and relationships.

It should be understood that each blade (50) may be mounted to hub (40) at any suitable pitch or angle of attack, about the axis defined by each blade (50), relative to the plane defined by hub (40). Such a pitch or angle of attack may impact the performance of fan system (10) (e.g., in terms of air flow volume and/or velocity, power consumption during normal operation, etc.). For instance, in some settings, it may be desirable to have blades (50) mounted at a relatively steep angle of attack relative to hub (40) and to rotate hub (40) and blades (50) relatively slowly. In some other settings, it may be desirable to have blades (50) mounted at a relatively shallower angle of attack relative to hub (40) and to rotate hub (40) and blades (50) relatively faster. Such "tradeoffs" in angle of attack versus rotation speed may ultimately yield substantially similar air flow in both examples, with other conditions such as power consumption, etc. varying among the two above examples. Alternatively, the air flow and/or other conditions may be different among the two above examples; and/or the power consumption and/or other conditions may be similar among the two above examples. Various settings in which one particular angle of attack may be desirable over another angle of attack, and in which one rotational speed may be desirable over another rotational speed, will be apparent to those of ordinary skill in the art in view of the teachings herein. Similarly, particular angles of attack that may be desirable, as well as particular rotational speeds that may be desirable, will be apparent to those of ordinary skill in the art in view of the teachings herein.

In some versions of fan system (10), the angle of attack is fixedly predetermined. For instance, tabs (42) of hub (40) and the interior of each fan blade (50) may be configured such that tabs (42) and blades (50) do not permit adjustment of the angle of attack. The angle of attack may thus be defined by the angle at which tabs (42) are oriented relative to the remainder of hub (40) (e.g., as defined by casting and/or bending/twisting) and/or by the features and configuration of the interior of each fan blade (50). In the present example, however, the configurations of tabs (42) and the interior of blades (50) provide sufficient clearance to introduce inserts (60, 70, 80) within the interior of each blade (50), between the upper interior surface (54) of each blade (50) and the corresponding tab (42). FIG. 6 shows various angles of attack that may be provided by inserts (60, 70, 80). Merely illustrative examples of such inserts (60, 70, 80) will be described in greater detail below with reference to FIGS. 7-12, while other suitable variations, substitutes, and supplements for inserts (60, 70, 80) will be apparent to those of ordinary skill in the art in view of the teachings herein.

Figure 7:
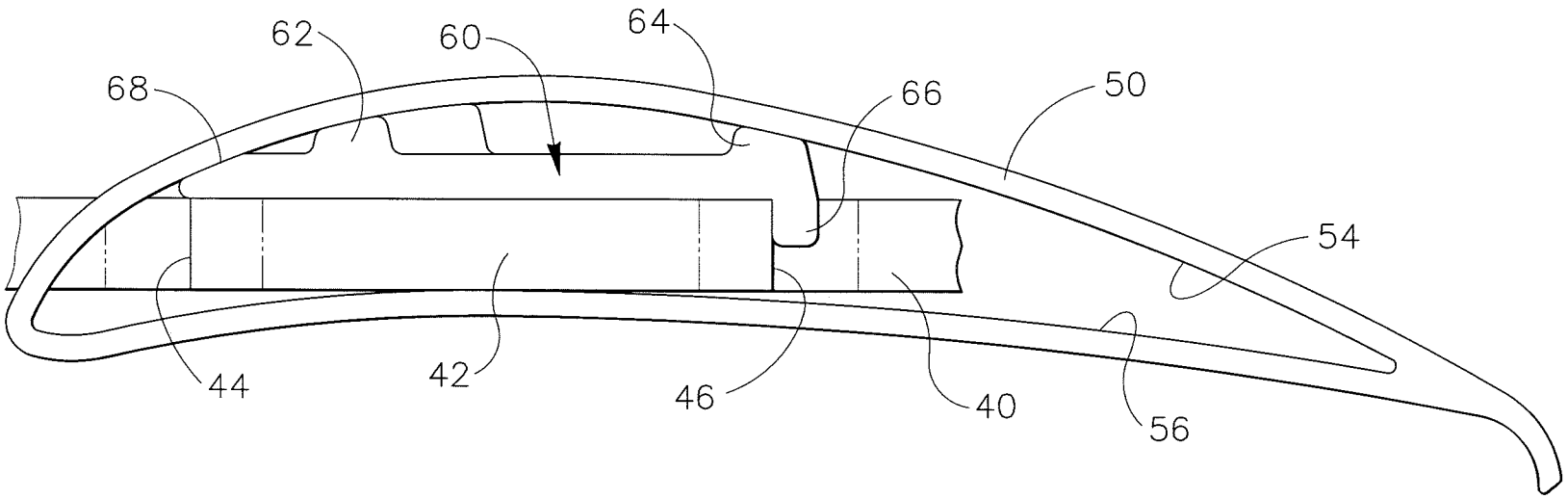
FIG. 7 depicts an end view of a fan blade portion, a hub portion, and an exemplary pitch angle insert portion.
Figure 8:
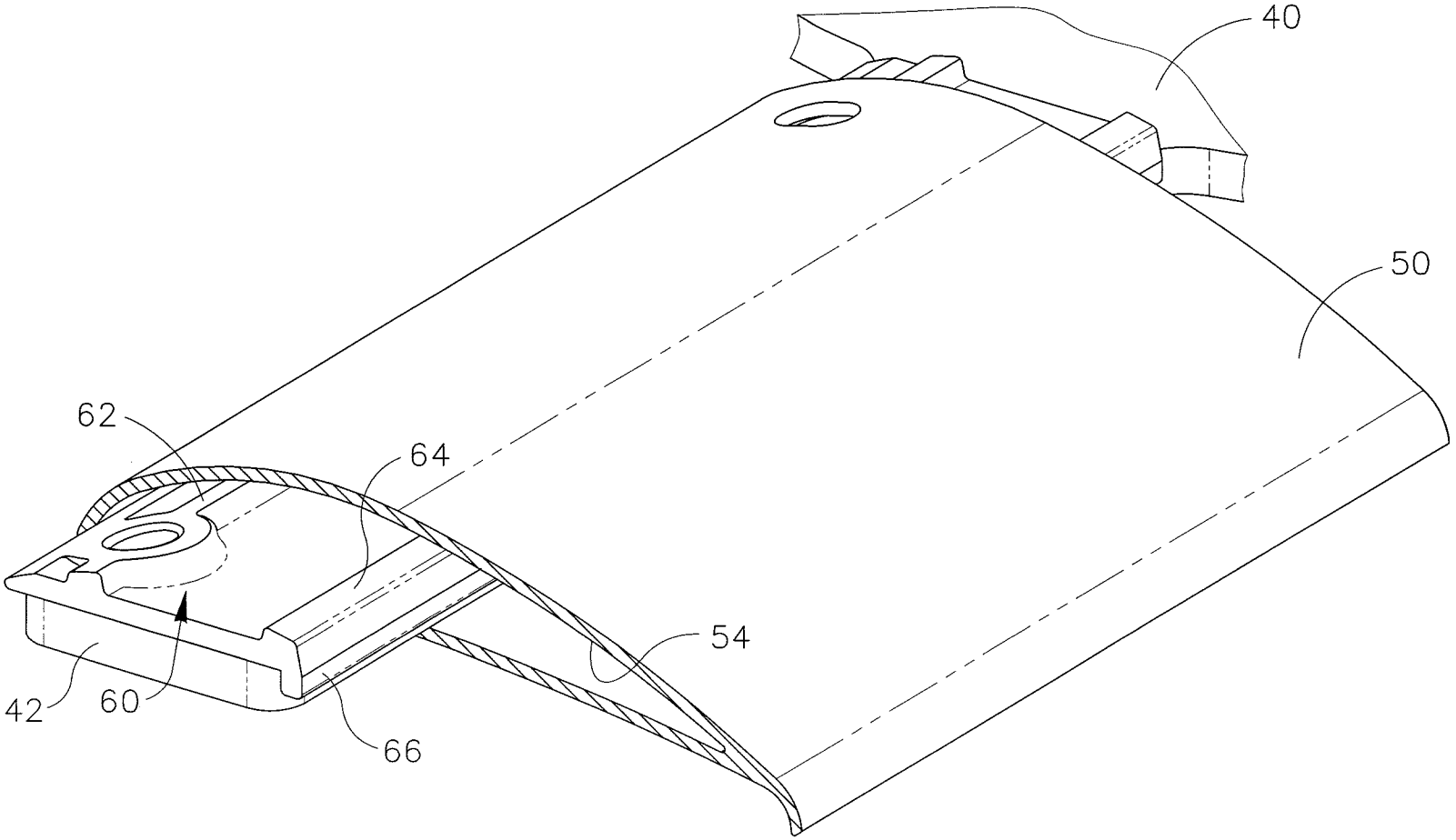
FIG. 8 depicts a top perspective view of the fan blade portion, hub portion, and exemplary pitch angle insert portion of FIG. 7.

One merely illustrative example of an insert (60) is shown in FIGS. 7-8. As shown, insert (60) has two upper bosses (62, 64) and a lower boss (66). Bosses (62, 64, 66) extend along the full length of insert (60) in this example. However, it should be understood that bosses (62, 64, 66) may extend along a portion of the length of insert (60); and/or may that bosses (62, 64, 66) be broken up along their length. Similarly, insert (60) of the present example has a length that is approximately equal to the length of each tab (42), though it should be understood that insert (60) may have any other suitable length. While insert (60) of the present example is formed of molded plastic, it should be understood that any other suitable material(s) (including combinations of materials) and/or any other suitable technique(s) (including combinations of techniques) may be used to form insert (60). Insert (60) of the present example also has a cross-sectional profile that is substantially uniform along its length, though such a profile may alternatively have any other suitable properties.

As shown in FIGS. 7-8, insert (60) is configured to fit between the upper surface of tab (42) and upper interior surface (54) of blade (50). In particular, boss (62) directly engages upper interior surface (54) of blade (50), near the leading edge of blade (50). Boss (64) directly engages upper interior surface (54) of blade (50), near the central region of blade (50) (i.e., relative to the chord of blade (50)). Bosses (62, 64) have a configuration such that they complement the curvature of interior surface (54) of blade (50) along the regions where bosses (62, 64) engage interior surface (54) of blade (50), providing a substantially flush fit. The leading edge (68) of insert (60) also directly engages interior surface (54) of blade (50), and has a configuration complementing the curvature of interior surface (54) of blade (50) along the region where leading edge (68) engages interior surface (54) of blade (50), providing a substantially flush fit. Boss (66) directly engages trailing edge (46) of tab (42) in this example. Bosses (62, 64, 66) and leading edge (68) of insert (60) thus provide a substantially snug fit between blade (50) and tab (42). When fasteners (56) are inserted through blade (50) and tab (42) in the present example, such fasteners (56) also pass through insert (60), thereby further securing insert (60) in place. Alternatively, insert (60) may be secured in any other suitable fashion.

Insert (60) of the present example is configured such that it provides blade (50) with an angle of attack of approximately 5°. In other words, when insert (60) is positioned between blade (50) and tab (42), blade (50) is mounted at an angle of attack (relative to hub (40)) of approximately 5°. It should be understood, however, that insert (60) may provide any other suitable angle of attack. It should also be understood that insert (60) may have a variety of other features, components, configurations, functionalities, and operability. By way of example only, insert (60) may directly engage the lower interior surface (56) of blade (50), in addition to or in lieu of directly engaging upper interior surface (54) of blade (50). Other suitable variations will be apparent to those of ordinary skill in the art in view of the teachings herein.

Figure 9:
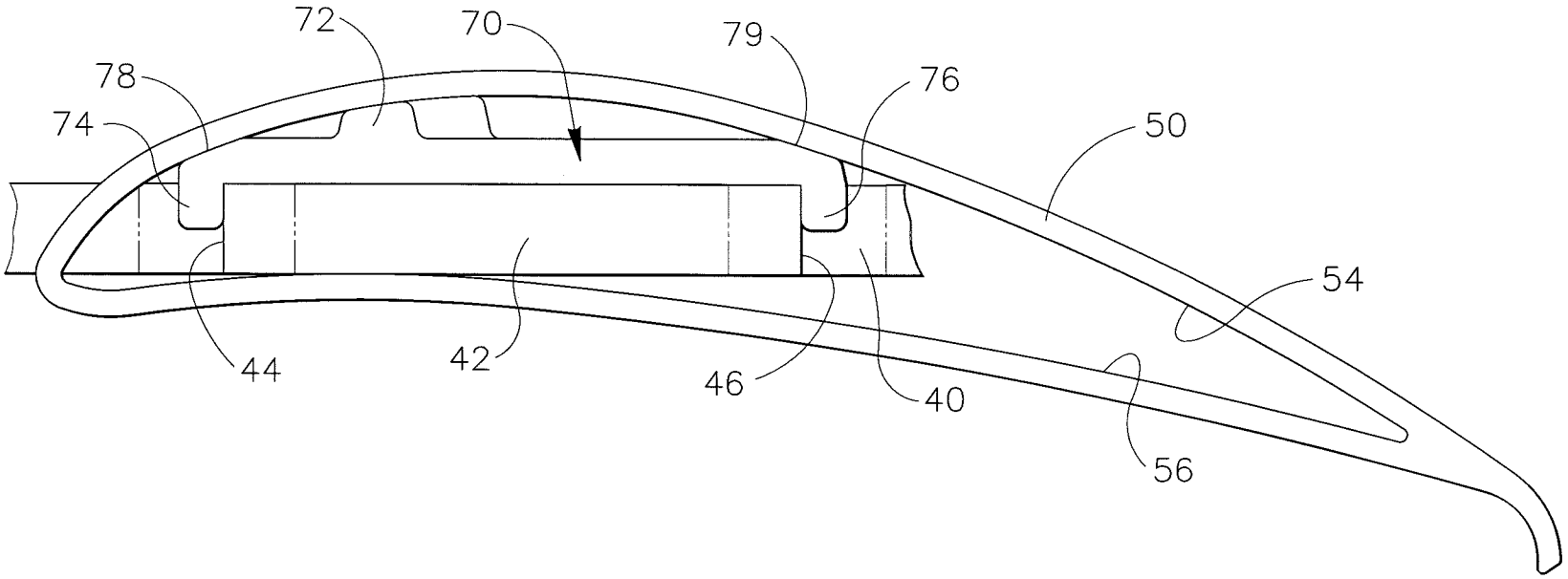
FIG. 9 depicts an end view of a fan blade portion, a hub portion, and another exemplary pitch angle insert portion.
Figure 10:
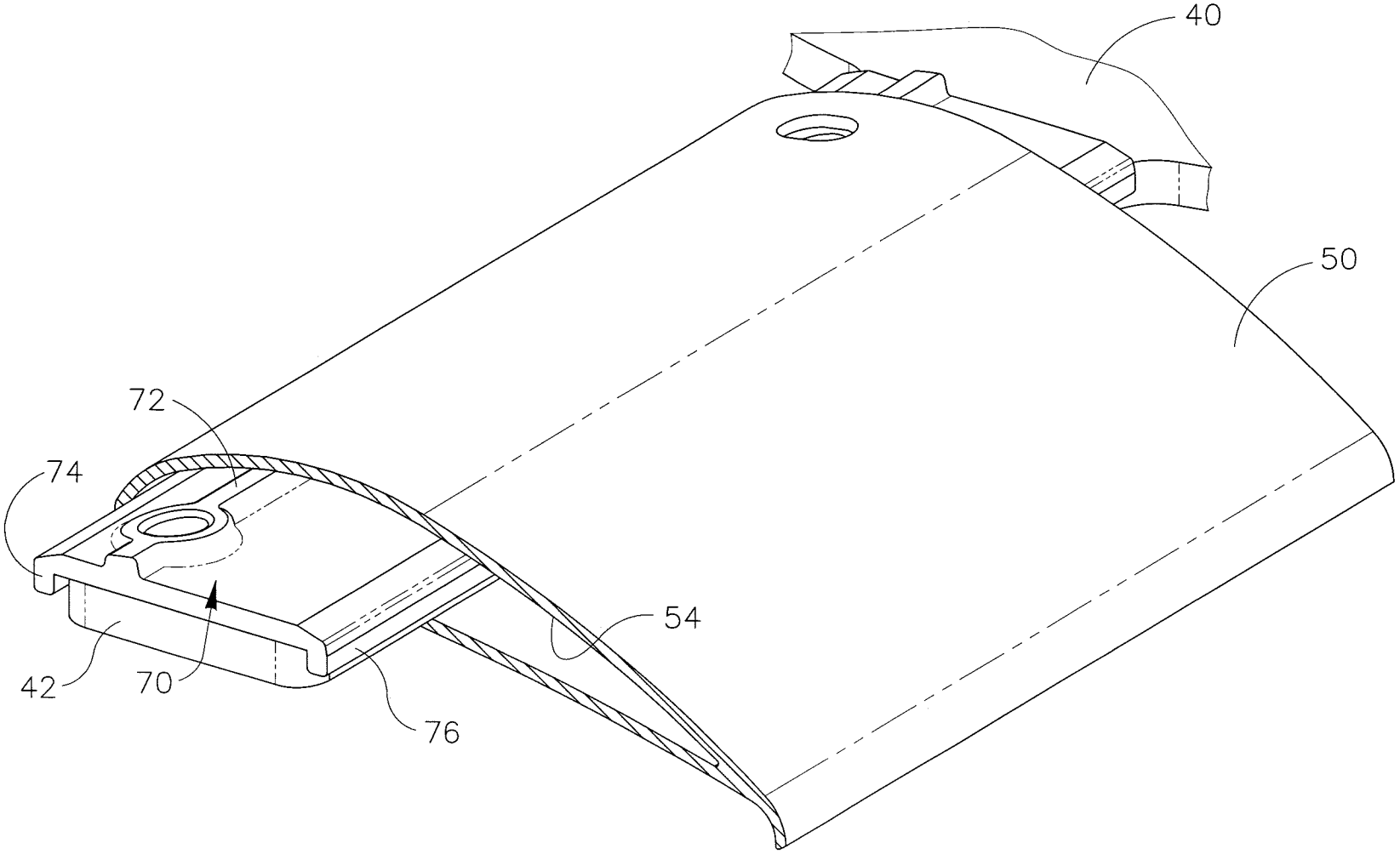
FIG. 10 depicts a top perspective view of the fan blade portion, hub portion, and exemplary pitch angle insert portion of FIG. 9.

Another merely illustrative example of an insert (70) is shown in FIGS. 9-10. As shown, insert (70) has an upper boss (72) and two lower bosses (74, 76). Bosses (72, 74, 76) extend along the full length of insert (70) in this example. However, it should be understood that bosses (72, 74, 76) may extend along a portion of the length of insert (70); and/or may that bosses (72, 74, 76) be broken up along their length. Similarly, insert (70) of the present example has a length that is approximately equal to the length of each tab (42), though it should be understood that insert (70) may have any other suitable length. While insert (70) of the present example is formed of molded plastic, it should be understood that any other suitable material(s) (including combinations of materials) and/or any other suitable technique(s) (including combinations of techniques) may be used to form insert (70). Insert (70) of the present example also has a cross-sectional profile that is substantially uniform along its length, though such a profile may alternatively have any other suitable properties.

As shown in FIGS. 9-10, insert (70) is configured to fit between the upper surface of tab (42) and upper interior surface (54) of blade (50). In particular, boss (72) directly engages upper interior surface (54) of blade (50), near the leading edge of blade (50). Boss (72) has a configuration such that it complements the curvature of interior surface (54) of blade (50) along the region where boss (72) engages interior surface (54) of blade (50), providing a substantially flush fit. The leading edge (78) and trailing edge (79) of insert (60) also directly engage interior surface (54) of blade (50), and have a configuration complementing the curvature of interior surface (54) of blade (50) along the regions where leading edge (78) and trailing edge (79) engage interior surface (54) of blade (50), also providing a substantially flush fit. Boss (74) directly engages leading edge (44) of tab (42) in this example; while boss (76) directly engages trailing edge (46) of tab (42) in this example. Bosses (72,74,76), leading edge (78), and trailing edge (79) of insert (70) thus provide a substantially snug fit between blade (50) and tab (42). When fasteners (56) are inserted through blade (50) and tab (42) in the present example, such fasteners (56)

also pass through insert (70), thereby further securing insert (70) in place. Alternatively, insert (70) may be secured in any other suitable fashion.

Insert (70) of the present example is configured such that it provides blade (50) with an angle of attack of approximately 10°. In other words, when insert (70) is positioned between blade (50) and tab (42), blade (50) is mounted at an angle of attack (relative to hub (40)) of approximately 10°. It should be understood, however, that insert (70) may provide any other suitable angle of attack. It should also be understood that insert (70) may have a variety of other features, components, configurations, functionalities, and operability. By way of example only, insert (70) may directly engage the lower interior surface (56) of blade (50), in addition to or in lieu of directly engaging upper interior surface (54) of blade (50). Other suitable variations will be apparent to those of ordinary skill in the art in view of the teachings herein.

Figure 11:
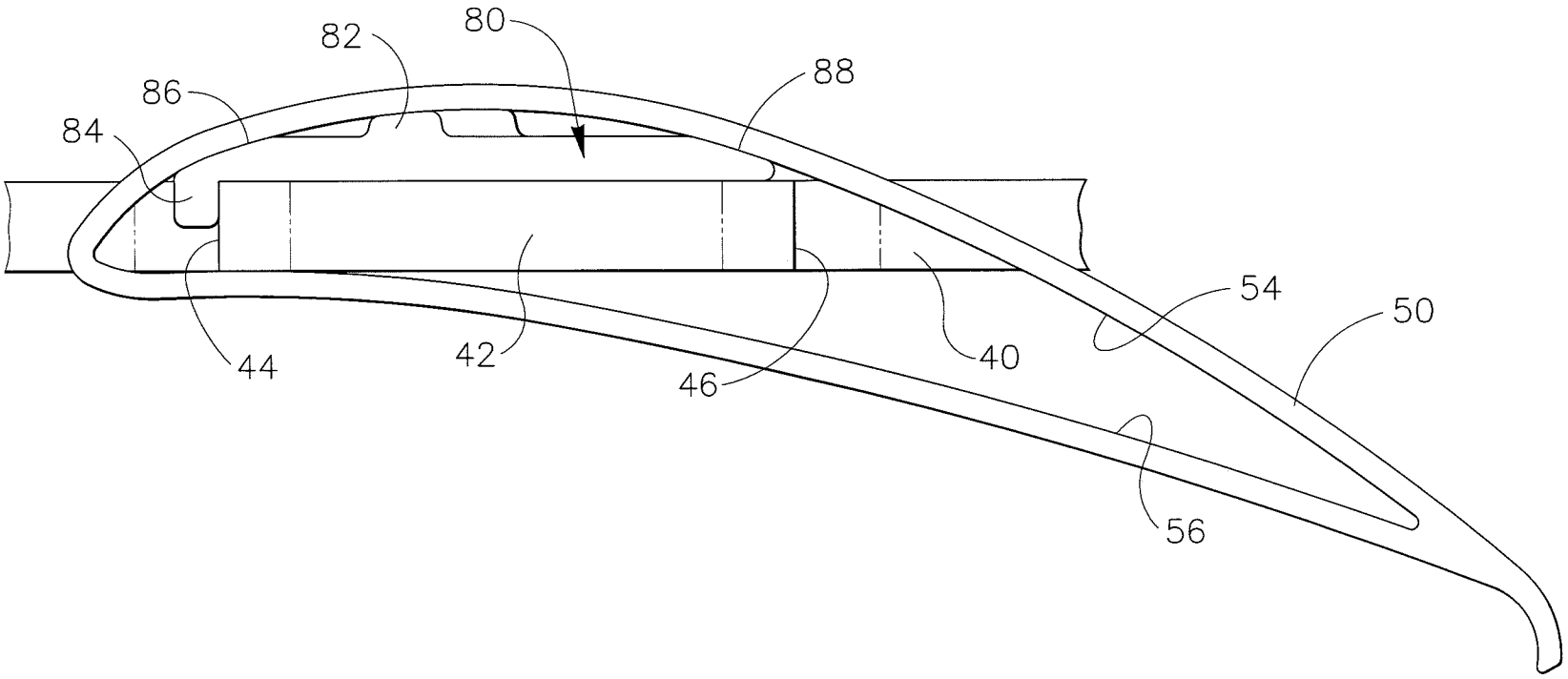
FIG. 11 depicts an end view of a fan blade portion, a hub portion, and yet another exemplary pitch angle insert portion.
Figure 12:
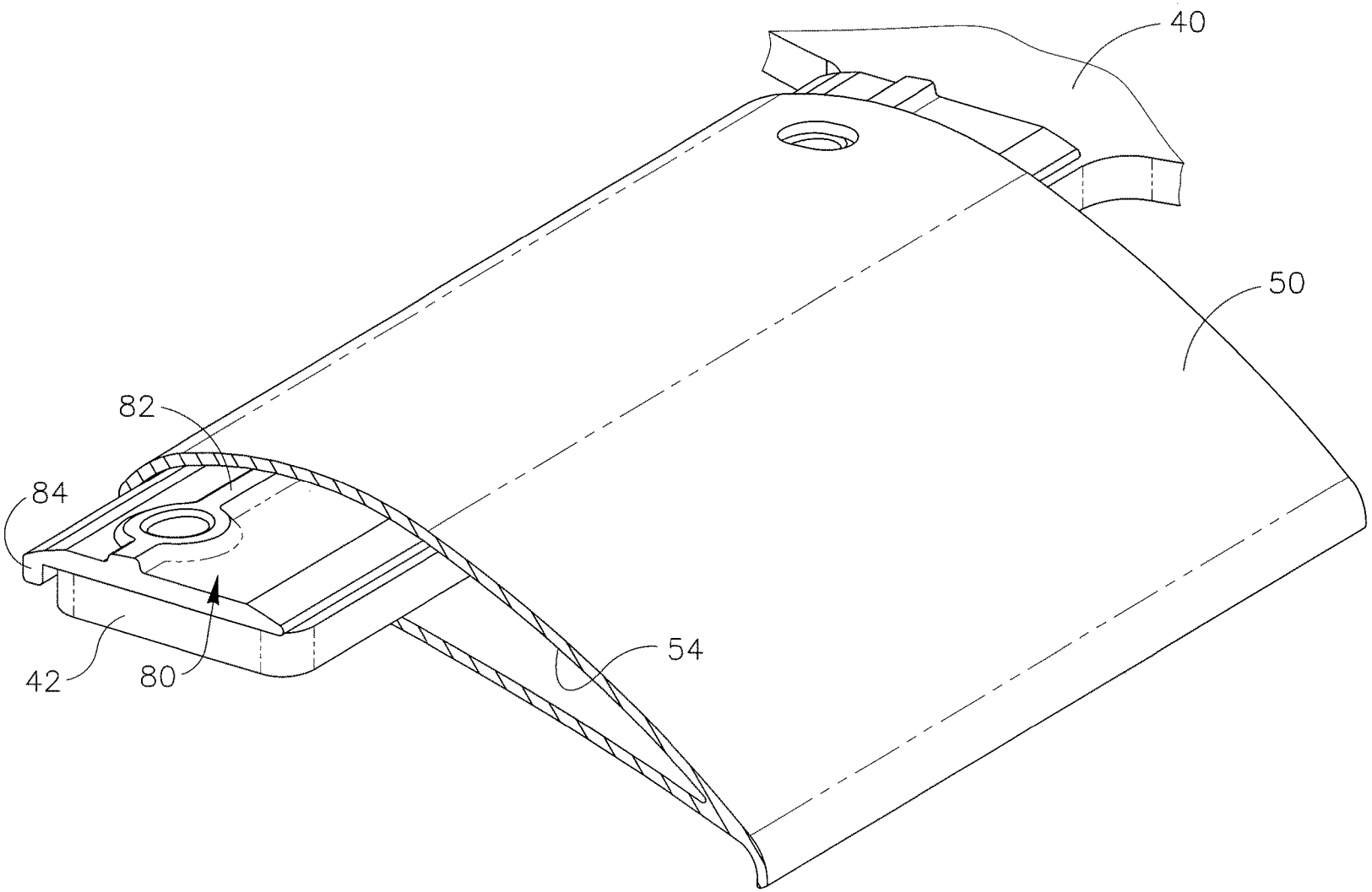
FIG. 12 depicts a top perspective view of the fan blade portion, hub portion, and exemplary pitch angle insert portion of FIG. 11.

Yet another merely illustrative example of an insert (80) is shown in FIGS. 11-12. As shown, insert (80) has an upper boss (82) and a lower boss (84). Bosses (82, 84) extend along the full length of insert (80) in this example. However, it should be understood that bosses (82, 84) may extend along a portion of the length of insert (80); and/or may that bosses (82, 84) be broken up along their length. Similarly, insert (80) of the present example has a length that is approximately equal to the length of each tab (42), though it should be understood that insert (80) may have any other suitable length. While insert (80) of the present example is formed of molded plastic, it should be understood that any other suitable material(s) (including combinations of materials) and/or any other suitable technique(s) (including combinations of techniques) may be used to form insert (80). Insert (80) of the present example also has a cross-sectional profile that is substantially uniform along its length, though such a profile may alternatively have any other suitable properties.

As shown in FIGS. 11-12, insert (80) is configured to fit between the upper surface of tab (42) and upper interior surface (54) of blade (50). In particular, boss (82) directly engages upper interior surface (54) of blade (50), near the leading edge of blade (50). Boss (82) has a configuration such that it complements the curvature of interior surface (54) of blade (50) along the region where boss (82) engages interior surface (54) of blade (50), providing a substantially flush fit. The leading edge (86) and trailing edge (88) of insert (80) also directly engage interior surface (54) of blade (50), and have a configuration complementing the curvature of interior surface (54) of blade (50) along the regions where leading edge (86) and trailing edge (88) engage interior surface (54) of blade (50). Boss (84) directly engages leading edge (44) of tab (42) in this example. Bosses (82, 84), leading edge (86), and trailing edge (88) of insert (80) thus provide a substantially snug fit between blade (50) and tab (42). When fasteners (56) are inserted through blade (50) and tab (42) in the present example, such fasteners (56) also pass through insert (80), thereby further securing insert (80) in place. Alternatively, insert (80) may be secured in any other suitable fashion.

Insert (80) of the present example is configured such that it provides an angle of attack of approximately 15°. In other words, when insert (80) is positioned between blade (50) and tab (42), blade (50) is mounted at an angle of attack (relative to hub (40)) of approximately ISO. It should be understood, however, that insert (80) may provide any other suitable angle of attack. It should also be understood that insert (80) may have a variety of other features, components, configurations, functionalities, and operability. By way of example only, insert (80) may directly engage the lower interior surface (56) of blade (50), in addition to or in lieu of directly engaging upper interior surface (54) of blade (50). Other suitable variations will be apparent to those of ordinary skill in the art in view of the teachings herein.

It should be understood from the foregoing that inserts (60, 70, 80) permit the angle of attack at which blades (50) are mounted relative to hub (40) to be adjusted, even with tabs (42) being substantially flat and co-planar with the remainder of hub (40). It should therefore be understood from the foregoing that inserts (60, 70, 80) permit the angle of attack at which blades (50) are mounted relative to hub (40) to be adjusted without having to change the geometry of hub (40) or tabs (42). Furthermore, it should be understood from the foregoing that inserts (60, 70, 80) permit the angle of attack at which blades (50) are mounted relative to hub (40) to be adjusted without having to change the geometry of blades (50). Thus, inserts (60, 70, 80) permit the same blade (50) to be mounted to the same hub (40) at various angles of attack, merely by choosing the appropriate insert (60, 70, 80) without having to make any other changes. Inserts (60, 70, 80) may thus be provided in a kit with fan system (10), permitting the end-user of fan system (10) to adjust the angle of attack as desired. Alternatively, inserts (60, 70, 80) may be selected during the assembly process before fans system (10) reaches an end-user, allowing fan system (10) to be customized before being sent to the end-user. Of course, inserts (60, 70, 80) may be otherwise provided and/or used.

While angles of attack of approximately 5°, approximately 10°, and approximately 15° are used in the above examples of inserts (60, 70, 80), any other suitable angles of attack may be used. Similarly, while three types of inserts (60, 70, 80) are described above, it should be understood that any other suitable number of inserts (60, 70, 80) may be provided and/or selected from in order to define or change the angle of attack of blades (50). Furthermore, any other suitable components or techniques, in addition to or in lieu of inserts (60, 70, 80), may be used to change the angle of attack of blades (50).

Variable Speed Control

Figure 13:
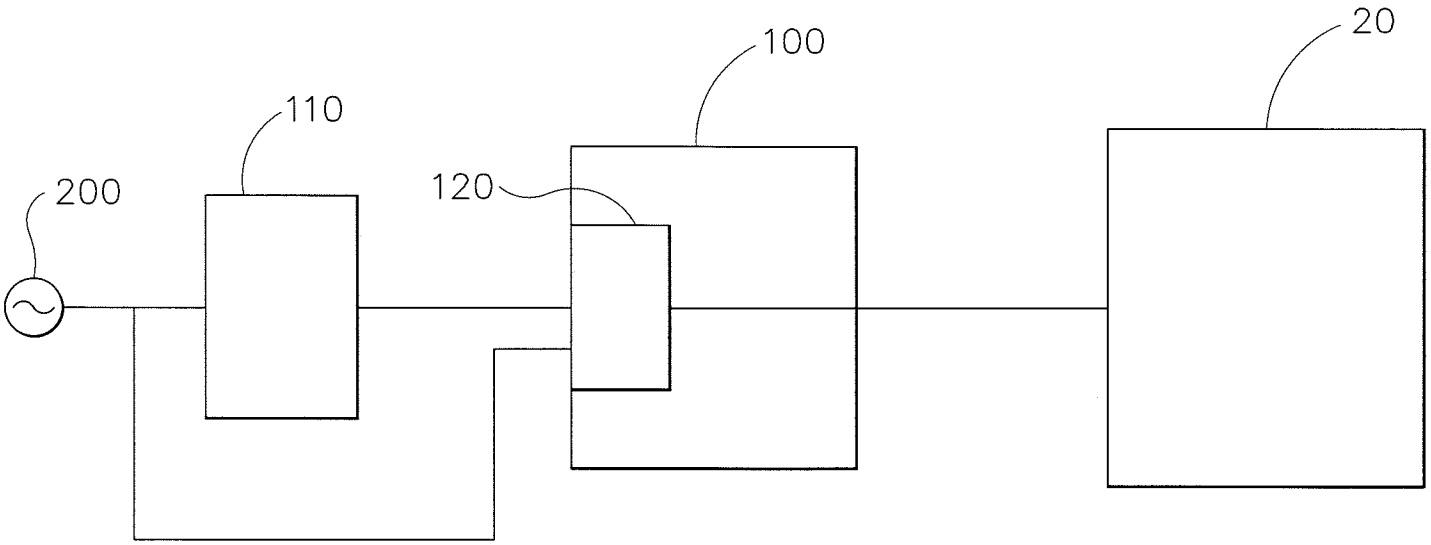
FIG. 13 depicts a schematic view of an exemplary control system for the fan system of FIG. 1.

Fan system (10) of the present example further provides speed control that is infinitely adjustable within a predefined range. In other words, and as shown in FIG. 13, fan system (10) includes a control module (100) that is operable to variably control the speed at which motor (20) rotates hub (40), thereby providing variable control of the air flow generated by blades (50). Such variable speed control may be provided through a dimmer switch (110) (e.g., slider, rotatable knob, etc.), such as a conventional dimmer switch commonly used for lighting systems. Those of ordinary skill in the art will recognize that a conventional dimmer switch (110) commonly used for lighting systems may provide a power level that is infinitely adjustable within a predefined range. For instance, a conventional dimmer switch (110) commonly used for lighting systems may provide adjustability of power to any desired intensity between zero intensity and full intensity. As will be described in greater detail below, such adjustability may be applied to some versions of fan system (10).

While dimmer switch (110) is described as providing a power level that is "infinitely adjustable" within a certain range, those of ordinary skill in the art will appreciate that, as a practical matter, the number of selectable power levels within the range may not be truly infinite. Nevertheless, the number of power levels that are available within the range may "seem" infinite, particularly when compared to conventional variable fan speed controls. For instance, a dimmer switch (110) may provide thousands of available power levels and corresponding speeds within a certain range; while a conventional variable fan speed control may only provide between three and four available power levels and corresponding speeds (e.g., "high," "medium," or "low"). Thus, the terms "infinite," "infinitely," and the like as used herein should not be read as necessarily requiring truly infinite numbers of available power levels or speeds. Instead, those terms should be read to include controls where the number of power levels or speeds that are available within the range "seems" infinite, as will be understood by those of ordinary skill in the art in view of the teachings herein.

Figure 14:
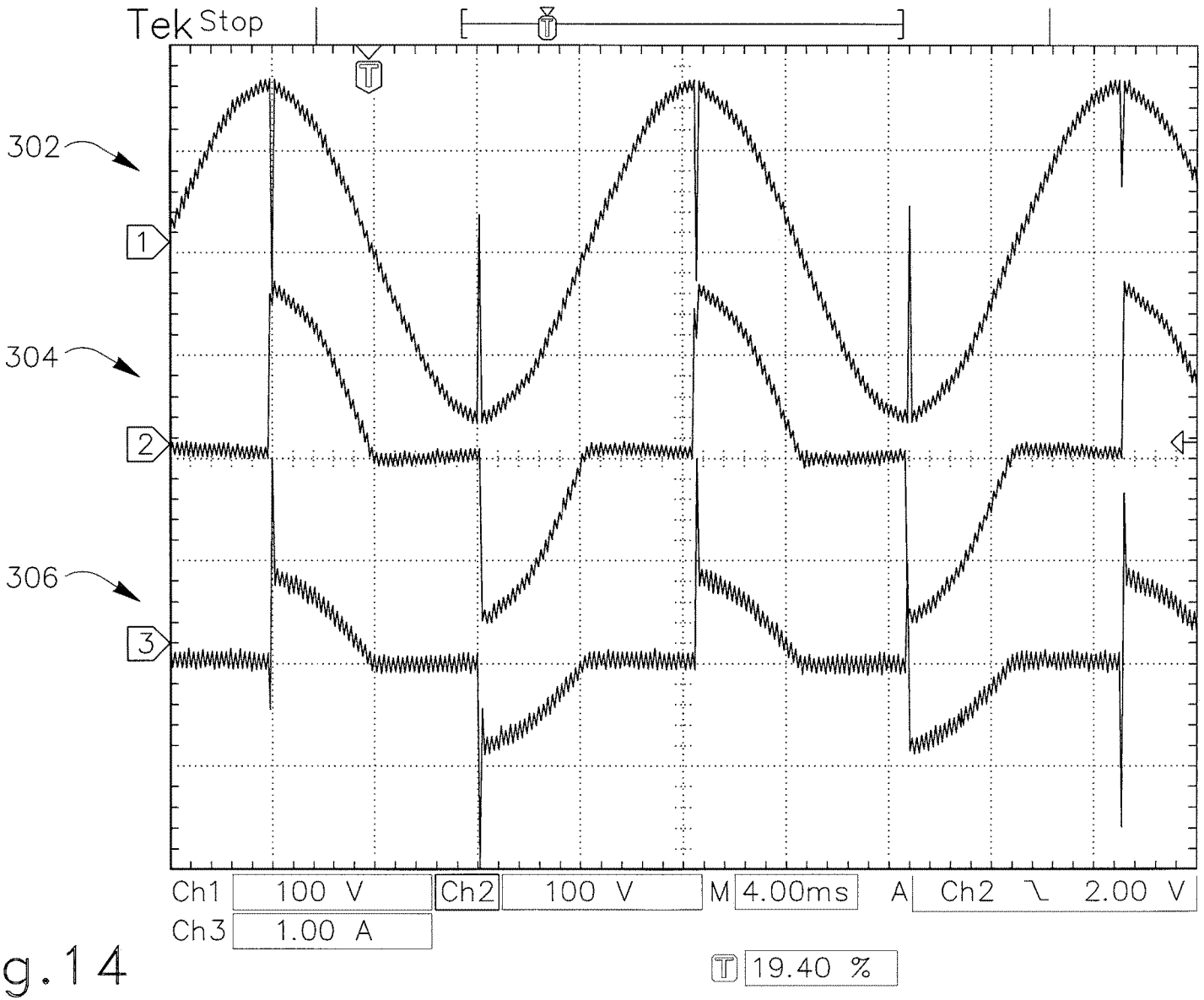
FIG. 14 depicts an oscillograph of waveforms that may be observed when an exemplary light dimmer is used to deliver power to a 60 watt (W) light bulb for approximately ½ of the AC cycle.
Figure 15:
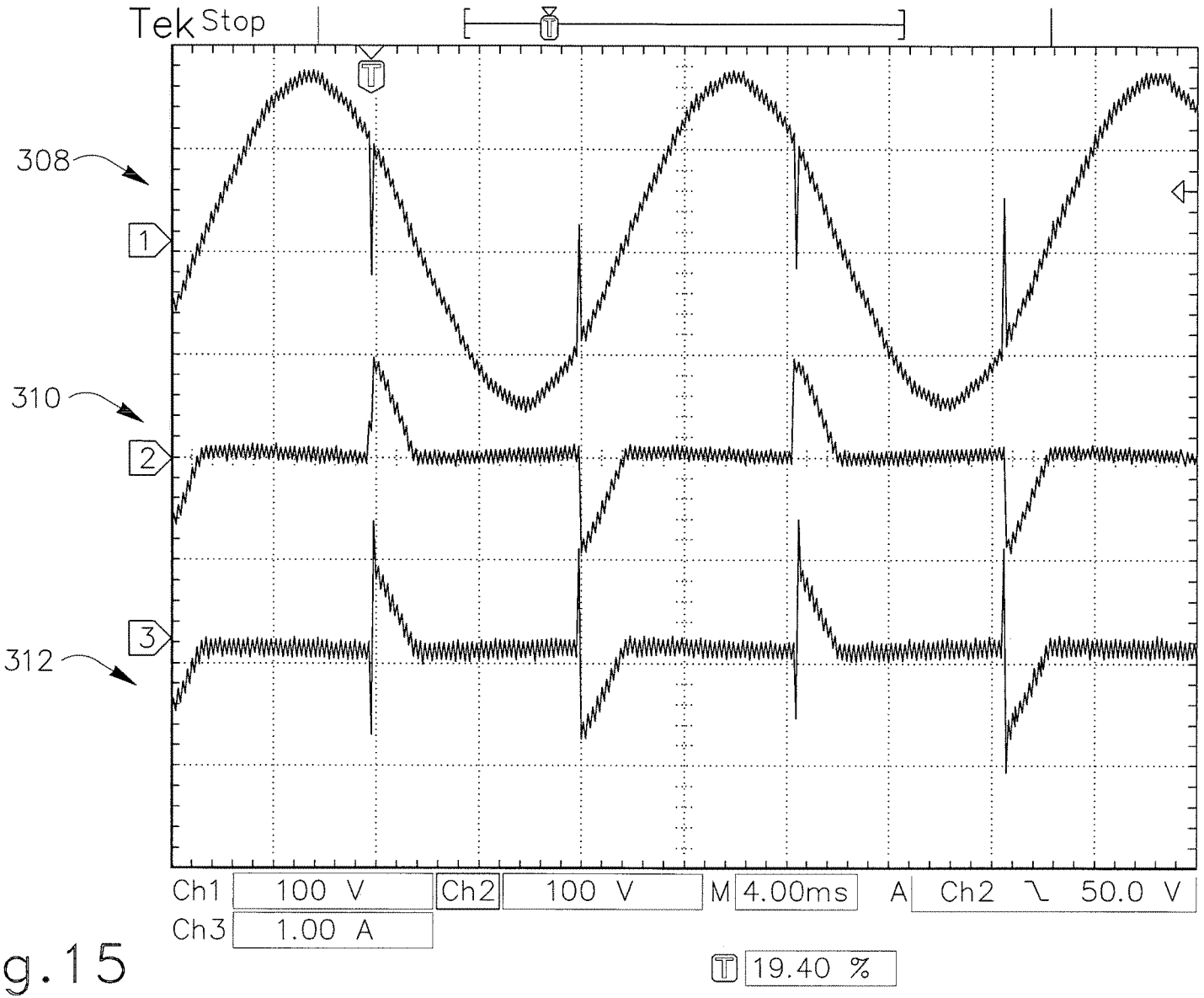
FIG. 15 depicts an oscillograph of waveforms that may be observed at minimum output from the light dimmer of FIG. 14.
Figure 16:
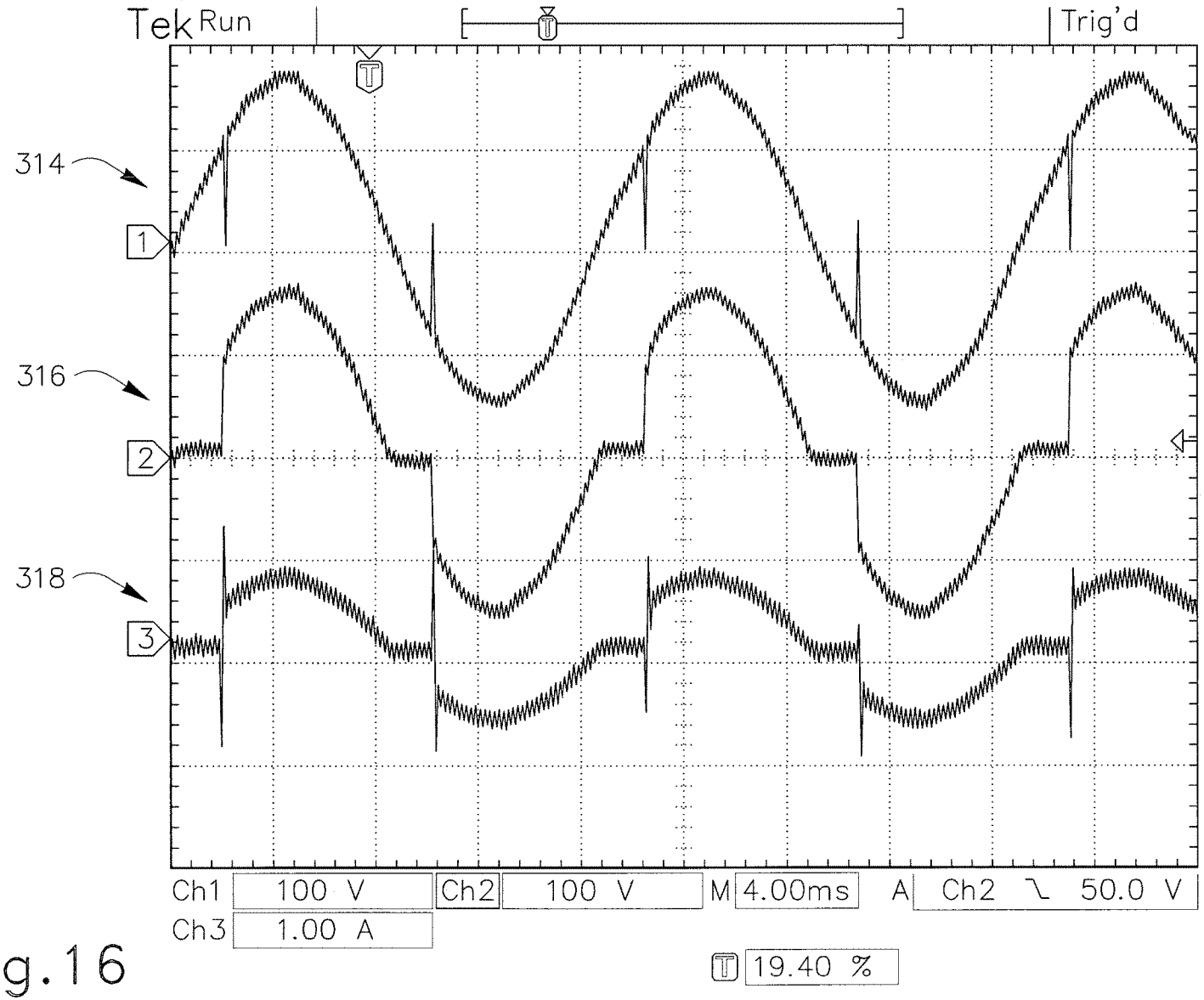
FIG. 16 depicts an oscillograph of waveforms that may be observed at maximum output from the light dimmer of FIG. 14.

A conventional light dimmer may be used to reduce the amount of Alternating-Current (AC) power delivered to an incandescent light bulb, causing the bulb to produce less light than would be available if the full AC voltage was applied to it. Conventional light dimmers may utilize a Triac to control the application of AC power to the light bulb load. A conventional Triac may essentially a bi-directional Silicon-Controlled-Rectifier (SCR) switching device, which allows current to flow in either direction through it, delivering power to the load during both halves of the AC cycle. The timing of the application of the gate signal to the Triac may determine how much power is delivered to the load. If the Triac is triggered to turn on late in the AC cycle, then the amount of power applied to the load may be a fraction of the power that would be available if the Triac is triggered to turn on early in the AC cycle. FIG. 14 is an oscillograph of the waveforms (302, 304, 306) that may be observed when a Leviton ATI06 light dimmer is used to deliver power to a 60 watt (W) light bulb for approximately ½ of the AC cycle. In comparison to a full AC cycle, this may result in approximately a 10% decrease in power applied to the bulb. Note that the power applied to the load is not necessarily linear with respect to the time that the voltage is applied. The top waveform (302) shows the 120 VAC line voltage, the middle waveform (304) shows the voltage applied to the load at the output of the light dimmer, and the bottom waveform (306) shows the current through the bulb. FIG. 15 is an oscillograph of the similar kinds of waveforms (308, 310, 312) that may be observed at minimum output from the light dimmer; and FIG. 16 is an oscillograph of the similar kinds of waveforms (314, 316, 318) that may be observed at maximum output from the light dimmer.

In order to operate reliably, a conventional Triac may require a minimum "holding current." This is defined as the current that is required to keep the Triac in the conducting state once it has been triggered "ON." The Triac will remain ON until the AC voltage transitions through the zero crossing point at the end of the half-cycle. It is for this reason that a minimum bulb wattage may be specified for light dimmers, the typical value being 40 W range for some dimmers. Some conventional dimmers may also be "smart," meaning that they have a microcomputer inside. By incorporating intelligence into the dimmer, features such as the following can be added: (1) "memory" that allows the dimmer to remember the last setting before power was removed or the dimmer switched off; (2) settings that can be stepped up and down between high and low; (3) LED's which indicate the present setting; and (4) fade on and off when the dimmer is switched between on and off. The "smart" dimmer may require some power to operate the internal circuitry, so there may be a period during each AC cycle when a voltage is present across the dimmer leads. Of course, light dimmers may have a variety of other components, features, configurations, and operabilities in addition to or in lieu of those components, features, configurations, and operabilities described above.

Some conventional fan systems may provide some degree of variable speed control by permitting selection of one predefined speed from a set of predefined speeds (e.g., "low," "medium," and "high," etc.). Such conventional fan systems do not allow an operator to select a speed that is not in the set of predefined speeds. In other words, such conventional fan systems do not allow the operator to select some speed that is between "low" and "medium" or between "medium" and "high." To the extent that a person would attempt to couple a conventional light dimmer (110) with such conventional fan systems, the results may be unsatisfactory. For instance, the motor in such a conventional fan system may produce undesirable noise during operation with a conventional light dimmer (110). The motor in such a conventional fan system may also operate erratically during operation with a conventional light dimmer (110). Other undesirable results may be realized when a person attempts to couple a conventional light dimmer (110) with a conventional fan system. It will therefore be understood by those of ordinary skill in the art that it is not a simple matter of design choice to simply couple a conventional light dimmer (110) with a fan system in an attempt to provide variable control of the fan system. In particular, it may be necessary in some instances to modify the control module of a fan system (and/or modify other components of the fan system and/or introduce additional components into the fan system) in order for the fan system to operate satisfactorily with a conventional light dimmer (110). Control module (100) described below represents one example of a control module that may be used in a fan system in order for the fan system to operate satisfactorily with a conventional light dimmer (110).

In some versions of fan system (10), the control module (100) for fan system (10) merely requires a low-level input control signal that is relatively noise-free and that can be controlled from a device located a considerable distance away. Control module (100) would then convert the control signal into a speed command and control power to motor (20) in such a way as to run fan system (10) at the set speed. The control signal might be a 0-10V DC analog signal, or a Pulse-Width-Modulated (PWM) duty-cycle control signal. Some versions of conventional light dimmers (110) are phase-control devices, designed to operate at household voltages of 120 or 240 VAC, and may require a minimum load of 40-60 Watts to operate reliably. Some versions of fan system (10) utilize a conventional light dimmer (110) to control the speed of motor (20), without incurring the "penalty" of 40 watt power dissipation that may be required by a conventional light dimmer (110).

As shown in FIG. 13, fan system (10) of the present example comprises motor (20), control module (100), and light dimmer (110). Control module (100) is in communication with motor (20), and is operable to control the speed at which motor (20) rotates. Control module (100) thus controls the speed at which blades (50) are rotated. Control module (100) includes a light dimmer interface (120), which allows control module (100) to accept and process control signals communicated from light dimmer (110). Light dimmer (110) and light dimmer interface (120) are both in communication with a conventional AC power source (200), which provides power to operate motor (20) (and, hence, operate fan system (10». As noted above, light dimmer (110) may comprise any suitable type of conventional light dimmer (e.g., with slider, with knob, with buttons, with touchscreen, etc.). Control module (100) may comprise any suitable type of control module, including but not limited to any type of control module disclosed in any of the patents, published patent applications, or other patent applications that are cited and incorporated by reference herein. Similarly, motor (20) may comprise any suitable type of motor (e.g., brushless, etc.), including but not limited to any type of motor disclosed in any of the patents, published patent applications, or other patent applications that are cited and incorporated by reference herein.

Figure 17:
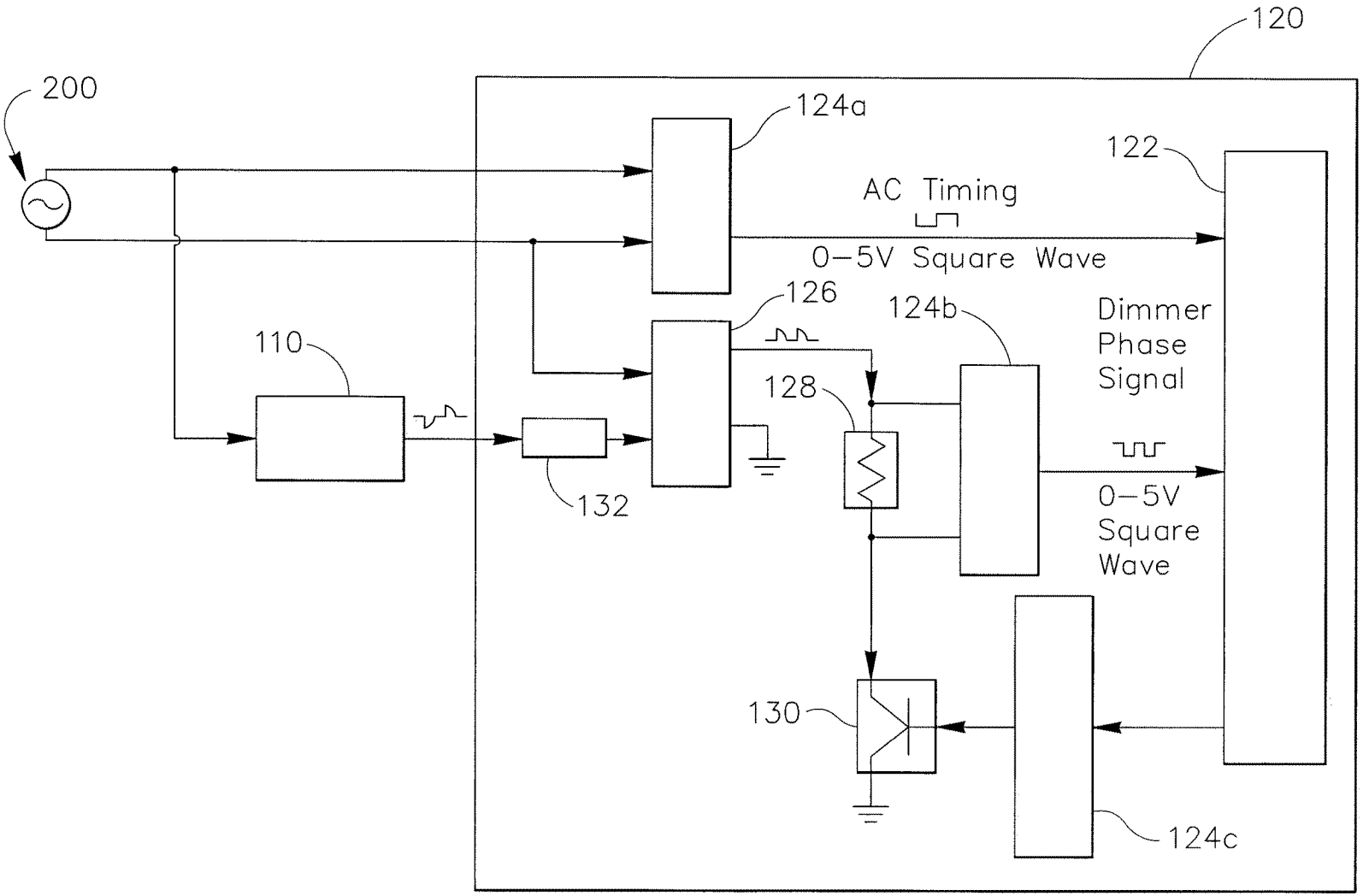
FIG. 17 depicts a schematic view of an exemplary fan dimmer interface component of the control system of FIG. 13.

A merely illustrative example of light dimmer interface (120) is shown in FIG. 17. As shown, light dimmer interface (120) of this example incorporates galvanic isolation between the AC line and a microcomputer (122) of light dimmer interface (120) using optical isolators (124*a*, 124*b*, 124*c*). In some versions, however, some circuitry can be eliminated by removing the optocouplers (124*a*, 124*b*, 124*c*). Microcomputer (122) of the present example comprises a microprocessor having at least two timers and being configured with control logic. Light dimmer interface (120) of the present example further comprises a full-wave rectifier (126), a load resistor (128), a load switch (130), and a fuse (132). Any of these components may be omitted, varied, substituted, supplemented, rearranged, or omitted, as desired. In the present example, load resistor (128) provides a resistance of approximately 240 ohms. However, it should be understood that load resistor (128) may alternatively provide any other suitable level of resistance. In some settings, it may be desirable for load resistor (128) to have a resistance value that is sufficiently low such that a current comparable to that of a 60 W light bulb is drawn from light dimmer (110). Load switch (130) of the present example comprises a MOSFET, though it should be understood that any other suitable type of transistor or any other suitable type of load switch may be used.

In the present example, the AC power from source (200) provides power to operate fan system (10), and such power is further used as a baseline for interface timing. The AC voltage feeds into an optical isolator (124*a*) where it is converted to a 0-5V square wave signal and sent on to microcomputer (122). A timer in microcomputer (122) counts from rising edge to rising edge in order to derive the timing for the AC. By utilizing this signal for the baseline timing, either a 50 Hz or 60 Hz power system can be accommodated. Alternatively, any other suitable type of power system may be accommodated. The voltage from light dimmer (110) passes through fuse (132) and enters full-wave rectifier (126) along with the opposite side of the AC line. By performing full-wave rectification of the dimmer voltage, the frequency of the signal may be doubled, and the signal may be kept always positive. After passing through full-wave rectifier (126), the rectified dimmer voltage is applied across load resistor (128). Current can only flow through load resistor (128) when load switch (130) is activated or turned on. Therefore, by allowing current to flow through load resistor (128) for only a brief time during each AC cycle, the dissipated power may be kept to a relative minimum in load resistor (128).

Continuing reference to FIG. 17, a square wave representing the AC signal is fed into microcomputer (122). Because, in some environments, the AC line can be quite noisy due to motors, compressors, or other equipment operating on the line, the square wave is filtered in software in the present example to help eliminate any transients that might occur. A first timer in microcomputer (122) is then used to time the square wave, or AC, cycle time. When a low-to-high or high-to-low transition occurs on the AC square wave, load switch (130) is turned on. Because of the power requirement of the "smart" dimmer mentioned previously, this period lasts a minimum of 500 microseconds (μsec) in some versions, and is timed by a second timer in microcomputer (122). Alternatively, any other suitable duration may be used. After the required 500 μsec waiting period in the present example, microcomputer (122) begins to monitor the dimmer signal input. When the Triac in light dimmer (110) turns on, current will start to flow through load resistor (128) and the signal into microcomputer (122) goes low, indicating to microcomputer (122) that light dimmer (110) has turned on. Microcomputer (122) then turns off load switch (130), stopping the flow of current through load resistor (128) for the duration of the AC half-cycle, and stores the count value in the first timer. Depending on whether it is the first or second AC half-cycle, the speed command "count" is calculated using the timer count for the previous complete AC cycle.

By way of example only, the "first half cycle command count" may equal half of the complete cycle count minus the first timer count value. The "second half cycle command count" may equal the complete cycle count minus the first timer count value. The two half cycle command counts are then added to a running average algorithm to derive a command count that has been averaged over a large number of cycles. Because the typical light dimmer may have a limited duty cycle range (e.g., between approximately 20% and approximately 80%), an offset value may be deducted from the command count. This value is then divided by half of the cycle count and is scaled to give a linear fan motor speed command over the complete range of fan operation. As can be seen, the minimal amount of time that current is allowed to flow through load resistor (128) may satisfy both the dimmer's minimum on time and current requirements, while drastically reducing the power dissipated in load resistor (128).

In some versions, the output of microcomputer (122) is provided directly to motor (20). In some other versions, the output of microcomputer (122) is fed to another component of control module (100), such that some other component of control module (100) sends control signals to motor (20). In addition or in the alternative, one or more outputs if microcomputer (122) may be coupled with one or more monitoring systems, one or more feedback systems, and/or one or more other types of systems or circuits. Various ways in which one or more outputs of microcomputer (122) may be used to ultimately drive motor (20), as well as various other ways in which one or more outputs of microcomputer (122) may be processed, will be apparent to those of ordinary skill in the art in view of the teachings herein.

In some versions, fan system (10) may operate with light dimmer (110), with motor (20) operating anywhere within its available RPM range, with the sound generated by motor (20) still being at less than approximately 58 decibels (C scale) measured at approximately 1 meter directly below hub (40). Alternatively, fan system (10) may operate at any other suitable decibel level.

Control module (100) may also be configured such that the maximum speed of motor (20) is predefined based on the length of blades (50) that will be used with fan system (10). By way of example only, the maximum speed may be set at approximately 45 RPM for 12-foot blades (50); at approximately 51 RPM for II-foot blades (50); at approximately 64 RPM for 10-foot blades (50); at approximately 80 RPM for 9-foot blades (50); and at approximately 100 RPM for 8-foot blades (50). Of course, any other suitable maximum speeds may be set based on any suitable factors. Such settings may be provided through dip switches or in any other suitable fashion. Alternatively, fan system (10) may lack the capability of establishing predefined maximum speeds based on the length of blades (50) and/or based on other factors.

Of course, the foregoing components and functionalities of dimmer interface (120) and other speed control components described above are merely illustrative. Any of those components may be omitted, varied, substituted, supplemented, rearranged, or omitted, as desired. It should also be understood that the speed control components and operability described herein may be applied to virtually any ceiling fan, and that the speed control components and operability described herein are not limited to fan system (10) of the present example. For instance, some versions of fan system (10) may have the speed control components and operability described herein without also having any inserts (60, 70, 80). The components and features described herein should thus be viewed as being independent of each other, though they could certainly be combined together in some versions of fan system (10). Various other types of fans in which inserts (60, 70, 80) and/or the speed control components and operability described herein may be used will be apparent to those of ordinary skill in the art in view of the teachings herein.

In addition to or in lieu of any of the above-mentioned components and features, fan system (10) may include an integral light. By way of example only, fan system (10) may include one or more lighting features as described in U.S. Provisional Patent App. No. 61/310,512, entitled "Fan with Integral Light," filed Mar. 4, 2010, the disclosure of which is incorporated by reference herein. Alternatively, any other suitable type(s) of lighting feature(s) may be used. Furthermore, lighting features may simply be omitted from fan system (10), if desired.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

We claim:

1. A fan, comprising:

(a) a hub, wherein the hub is rotatable about an axis, wherein the hub comprises a plurality of mounting tabs extending outwardly relative to the axis, wherein each mounting tab of the plurality of mounting tabs has a leading edge and a trailing edge;

(b) a plurality of fan blades, wherein each fan blade of the plurality of fan blades has a hollow interior, wherein the hollow interior of each fan blade is defined by at least one interior surface, wherein each mounting tab of the hub is inserted in the hollow interior of a corresponding fan blade of the plurality of fan blades; and (c) a plurality of removable inserts, wherein each insert further comprises an upper boss, wherein the upper boss of each insert is in contact with the interior surface of each corresponding fan blade, wherein each insert of the plurality of inserts is positioned in the hollow interior of each fan blade between each mounting tab of the plurality of mounting tabs and the interior surface of the corresponding fan blade to vary an angle of attack about an axis defined by each fan blade of the plurality of fan blades and wherein each insert of the plurality of inserts extends along approximately an entire length of each mounting tab of the plurality of mounting tabs.

2. The fan of claim 1, wherein each mounting tab of the plurality of mounting tabs has a substantially flat top surface.

3. The fan of claim 2, wherein each insert is in contact with the substantially flat top surface of each corresponding mounting tab.

4. The fan of claim 1, wherein each insert is in contact with the leading edge of each corresponding mounting tab.

5. The fan of claim 4, wherein each mounting tab further has a top surface, wherein each insert is also in contact with the top surface of each corresponding mounting tab.

6. The fan of claim 5, wherein each insert comprises a first portion and a downwardly extending boss, wherein the first portion of each insert is in contact with the top surface of each corresponding mounting tab, wherein the downwardly extending boss of each insert is in contact with the leading edge of each corresponding mounting tab.

7. The fan of claim 1, wherein each insert is in contact with the trailing edge of each corresponding mounting tab.

8. The fan of claim 7, wherein each mounting tab further has a top surface, wherein each insert is also in contact with the top surface of each corresponding mounting tab.

9. The fan of claim 8, wherein each insert comprises a first portion and a first downwardly extending boss, wherein the first portion of each insert is in contact with the top surface of each corresponding mounting tab, wherein the first downwardly extending boss of each insert is in contact with the trailing edge of each corresponding mounting tab.

10. The fan of claim 9, wherein each insert further comprises a second downwardly extending boss, wherein the second downwardly extending boss of each insert is in contact with the leading edge of each corresponding mounting tab.

11. The fan of claim 1, wherein the mounting tabs all lie along a common horizontal plane.

12. The fan of claim 11, wherein each fan blade defines a corresponding chord line, wherein each insert is configured to position and maintain the chord line of each corresponding fan blade at an oblique angle relative to the common horizontal plane.

13. The fan of claim 1, further including:

(a) a fan motor;

(b) a dimmer switch, wherein the dimmer switch is operable to provide substantially infinite adjustability of power within a range of power levels;

(c) a control module, wherein the control module is in communication with the fan motor such that the control module is operable to provide driving power to the fan motor, wherein the control module is further in communication with the dimmer switch such that the dimmer switch and the control module are together operable to provide the substantially infinite adjustability of driving power to the fan motor within the range of power levels, wherein the control module is configured to generate a scaled linear fan motor command signal based at least in part on a first half cycle command count and a second half cycle command count;

wherein the first half cycle command count equals half of a complete cycle count minus a first timer count value; and wherein the second half cycle command count equals the complete cycle count minus the first timer count value.

14. The fan of claim 1, wherein each insert has a cross-sectional profile that is substantially uniform along a length of the insert.

15. The fan of claim 1, wherein a first of the inserts includes a first profile shape adapted to fix a respective one of the plurality of blades at a first angle of attack, and wherein the a second of the inserts includes a second profile shape, different from the first profile shape, said second profile shape adapted to fix the respective one of the plurality of blades at a second angle of attack, different from the first angle of attack.

16. A fan kit, comprising:

(a) a hub, wherein the hub is rotatable about an axis, wherein the hub comprises a plurality of mounting tabs extending outwardly relative to the axis, wherein each mounting tab of the plurality of mounting tabs has a leading edge and a trailing edge;

(b) a plurality of fan blades, wherein each fan blade of the plurality of fan blades has a hollow interior, wherein the hollow interior of each fan blade is defined by at least one interior surface, wherein the hollow interior of each fan blade is configured to insertingly receive a corresponding mounting tab of the plurality of mounting tabs; and (c) a plurality of removable inserts, wherein the plurality of inserts are configured to be positioned in the hollow interior of the fan blades at locations between the mounting tabs and the interior surface of each fan blade, wherein each insert further comprises an upper boss, wherein the upper boss of each insert is in contact with the interior surface of each corresponding fan blade; wherein the inserts comprise:

(i) a first set of inserts, wherein the inserts of the first set of inserts define a first profile shape that is configured to provide the fan blades with a first angle of attack when the inserts of the first set and the mounting tabs are inserted in the hollow interiors of the fan blades, and wherein the inserts of the first set of inserts are in contact with a top surface of each corresponding mounting tab, and (ii) a second set of inserts, wherein the inserts of the second set of inserts define a second profile shape different from the first profile shape, wherein the second profile shape is configured to provide the fan blades with a second angle of attack different from the first angle of attack when the inserts of the second set and the mounting tabs are inserted in the hollow interiors of the fan blades, and wherein the inserts of the second set of inserts are in contact with the top surface of each corresponding mounting tab.

17. The fan kit of claim 16, wherein the first angle of attack is a first angle selected from the group consisting of approximately 5°, approximately 10°, and approximately 15°; wherein the second angle of attack is a second angle selected from the group consisting of approximately 5°, approximately 10°, and approximately 15°.

* * * * *